US010215009B2

(12) United States Patent
Tjostheim et al.

(10) Patent No.: US 10,215,009 B2
(45) Date of Patent: Feb. 26, 2019

(54) SYSTEM AND CONSOLE FOR MONITORING DATA STREAM QUALITY IN DRILLING AND PRODUCTION OPERATIONS AT A WELL SITE

(71) Applicants: Sigurd Tjostheim, Kristiansand (NO); Fereidoun Abbassian, Houston, TX (US); Per Arild Andresen, Kristiansand (NO); Stephen Tean Edwards, Hockley, TX (US); Mark Adrian Honey, Milltimber (GB); Nigel Charles Last, Weybridge (GB); Colin James Mason, Sunbury-On-Thames (GB); Trond Waage, Kristiansand (NO); Rune Arnt Skarbo, Amstelveen (NL); Thomas Hestenes Jakobsen, Hamresanden (NO); Paulo Jorge Da Cunha Gomes, Richmond (GB); Kevin Perry Richardson, Spring, TX (US); Jan Kare Igland, Lindesnes (NO); Sankarrappan Periyasamy, Katy, TX (US); Randall Vashishta Sant, Katy, TX (US)

(72) Inventors: Sigurd Tjostheim, Kristiansand (NO); Fereidoun Abbassian, Houston, TX (US); Per Arild Andresen, Kristiansand (NO); Stephen Tean Edwards, Hockley, TX (US); Mark Adrian Honey, Milltimber (GB); Nigel Charles Last, Weybridge (GB); Colin James Mason, Sunbury-On-Thames (GB); Trond Waage, Kristiansand (NO); Rune Arnt Skarbo, Amstelveen (NL); Thomas Hestenes Jakobsen, Hamresanden (NO); Paulo Jorge Da Cunha Gomes, Richmond (GB); Kevin Perry Richardson, Spring, TX (US); Jan Kare Igland, Lindesnes (NO); Sankarrappan Periyasamy, Katy, TX (US); Randall Vashishta Sant, Katy, TX (US)

( * ) Notice: Subject to any disclaimer, the term of this patent is extended or adjusted under 35 U.S.C. 154(b) by 604 days.

(21) Appl. No.: 14/320,580

(22) Filed: Jun. 30, 2014

(65) Prior Publication Data

US 2015/0015412 A1 Jan. 15, 2015

Related U.S. Application Data

(60) Provisional application No. 61/841,382, filed on Jun. 30, 2013.

(51) Int. Cl.
*E21B 44/00* (2006.01)
*E21B 41/00* (2006.01)

(52) U.S. Cl.
CPC ..... *E21B 44/00* (2013.01); *E21B 41/00* (2013.01)

(58) Field of Classification Search
CPC ..... E21B 44/00; E21B 41/00; E21B 47/00
(Continued)

(56) References Cited

U.S. PATENT DOCUMENTS 4,535,851 A 8/1985 Kirkpatrick et al.
4,571,993 A 2/1986 St. Onge
(Continued)

FOREIGN PATENT DOCUMENTS

GB 2460556 A 12/2009
WO WO200060780 A1 10/2000
(Continued)

OTHER PUBLICATIONS

PCT International Search Report and Written Opinion, PCT/US14/020293, Kongsberg Oil and Gas AS, filed Mar. 4, 2014.
(Continued)

*Primary Examiner* — Firmin Backer
*Assistant Examiner* — Jerold Murphy
(74) *Attorney, Agent, or Firm* — Wayne Edward Ramage; Baker Donelson

(57) ABSTRACT

A well advisor system and console for monitoring and managing monitoring and managing data stream quality in well drilling and production operations. The system may be accessed through one or more workstations, or other computing devices, which may be located at a well site or remotely. The system is in communication with and receives input from various sensors. It collects real-time sensor data
(Continued)

sampled during operations at the well site. The system processes the data, and provides nearly instantaneous numerical and visual feedback through a variety of graphical user interfaces ("GUIs"), which are presented in the form of an operation-specific console. A plurality of data checks are dynamically run on the data streams to determine the presence and quality of the data, and data quality indicators are presented on the various consoles and dashboards.

14 Claims, 23 Drawing Sheets

(58) Field of Classification Search
USPC ..... 340/853.1–853.2; 73/152.01–152.62; 166/250.01–250.17; 367/81–85
See application file for complete search history.

(56) References Cited

U.S. PATENT DOCUMENTS

| | | | | |
|---|---|---|---|---|
| 5,624,182 | A | 4/1997 | Dearing, Sr. et al. | |
| 6,152,246 | A | 11/2000 | King et al. | |
| 6,233,498 | B1 | 5/2001 | King et al. | |
| 6,282,452 | B1 | 8/2001 | Deguzman et al. | |
| 6,484,816 | B1 | 11/2002 | Koederitz | |
| 6,668,943 | B1 | 12/2003 | Maus et al. | |
| 7,706,980 | B2 | 4/2010 | Winters et al. | |
| 8,121,971 | B2 | 2/2012 | Edwards et al. | |
| 2003/0220742 | A1 | 11/2003 | Niedermayr et al. | |
| 2004/0124009 | A1 | 7/2004 | Hoteit | |
| 2005/0257610 | A1* | 11/2005 | Gillen | E21B 47/00 73/152.02 |
| 2005/0279532 | A1 | 12/2005 | Ballantyne et al. | |
| 2007/0056746 | A1 | 3/2007 | Newman | |
| 2007/0151762 | A1 | 7/2007 | Reitsma | |
| 2008/0105424 | A1 | 5/2008 | Remmert et al. | |
| 2008/0173480 | A1 | 7/2008 | Annaiyappa et al. | |
| 2008/0185143 | A1 | 8/2008 | Winters et al. | |
| 2009/0090555 | A1 | 4/2009 | Boone et al. | |
| 2009/0132458 | A1 | 5/2009 | Edwards et al. | |
| 2011/0025525 | A1 | 2/2011 | Akimov et al. | |
| 2011/0192598 | A1 | 8/2011 | Roddy et al. | |
| 2012/0123822 | A1 | 5/2012 | Hnatio | |
| 2012/0197527 | A1 | 8/2012 | Mckay et al. | |
| 2012/0205103 | A1 | 8/2012 | Ravi et al. | |
| 2012/0272174 | A1 | 10/2012 | Vogel et al. | |
| 2012/0274664 | A1 | 11/2012 | Fagnou | |
| 2013/0112416 | A1 | 5/2013 | Clemens et al. | |
| 2013/0135114 | A1 | 5/2013 | Ringer et al. | |
| 2013/0144531 | A1 | 6/2013 | Johnston | |
| 2013/0311093 | A1 | 11/2013 | Winters et al. | |
| 2013/0311097 | A1 | 11/2013 | Livesay et al. | |
| 2013/0187890 | A1 | 12/2013 | Chen et al. | |
| 2014/0006992 | A1* | 1/2014 | Broussard, III | G06F 3/04847 715/771 |
| 2014/0116776 | A1 | 5/2014 | Marx et al. | |
| 2014/0152456 | A1* | 6/2014 | Olson | G01V 3/18 340/853.2 |
| 2014/0246238 | A1 | 9/2014 | Abbassian et al. | |
| 2014/0299377 | A1 | 10/2014 | Abbassian et al. | |
| 2014/0299378 | A1 | 10/2014 | Abbassian et al. | |
| 2014/0303894 | A1 | 10/2014 | Abbassian et al. | |
| 2014/0309936 | A1 | 10/2014 | Abbassian et al. | |
| 2016/0053604 | A1* | 2/2016 | Abbassian | E21B 44/00 702/6 |

FOREIGN PATENT DOCUMENTS

| | | | |
|---|---|---|---|
| WO | WO2003100537 | A1 | 12/2003 |
| WO | WO2005018308 | A1 | 2/2005 |
| WO | WO2013142950 | A1 | 10/2013 |

OTHER PUBLICATIONS

PCT International Search Report and Written Opinion, PCT/US14/026082, Kongsberg Oll and Gas AS, filed Mar. 13, 2014.
PCT International Search Report and Written Opinion, PCT/US14/026112, Kongsberg Oll and Gas AS, filed Mar. 13, 2014.
PCT International Search Report and Written Opinion, PCT/US14/026128, Kongsberg Oll and Gas AS, filed Mar. 13, 2014.
PCT International Search Report and Written Opinion, PCT/US14/026155, Kongsberg Oll and Gas AS, filed Mar. 13, 2014.
PCT International Search Report and Written Opinion, PCT/US14/044965, Kongsberg Oll and Gas AS, filed Jun. 30, 2014.
PCT International Search Report and Written Opinion, PCT/US14/044967, Kongsberg Oll and Gas AS, filed Jun. 30, 2014.
PCT International Search Report and Written Opinion, PCT/US15/038793, Kongsberg Oll and Gas AS, filed Jul. 1, 2015.
PCT International Search Report and Written Opinion, PCT/US15/038805, Kongsberg Oll and Gas AS, filed Jul. 1, 2015.
PCT International Search Report and Written Opinion, PCT/US15/038816, Kongsberg Oll and Gas AS, filed Jul. 1, 2015.
PCT International Search Report and Written Opinion, PCT/US15/038832, Kongsberg Oll and Gas AS, filed Jul. 1, 2015.

* cited by examiner

QC Health Widget States

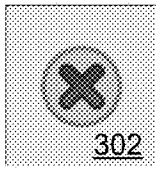

QC test(s) not configured or not running

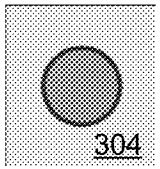

The system has not detected any alerts for the configured curve(s) /test(s).

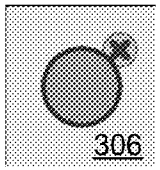

The system has not detected any alerts for the configured curve(s) /test(s) that are running, but there is a configuration problem for one or more of the configured curve(s) /test(s). This means you may not have the full picture of the situation since some of the test(s) may have a configuration problem.

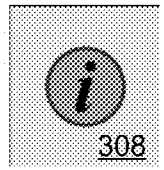

The system has not detected any alerts for the configured curve(s) /test(s) that are running, but within the last half hour there has been at least one active alert.

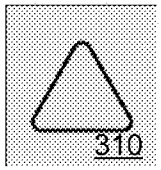

The system has detected at least one alert with medium severity for the configured curve(s) / test(s).

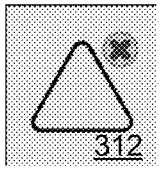

The system has detected at least one alert with medium severity for the configured curve(s) /test(s). In addition there is a configuration problem for one or more of the configured curve(s) /test(s).

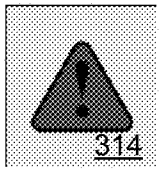

The system has detected at least one alert with high severity for the configured curve(s) /test(s).

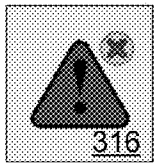

The system has detected at least one alert with high severity for the configured curve(s) / test(s). In addition there is a configuration problem for one or more of the configured curve(s) /test(s).

FIGURE 10

SYSTEM AND CONSOLE FOR MONITORING DATA STREAM QUALITY IN DRILLING AND PRODUCTION OPERATIONS AT A WELL SITE

This application claims benefit of and priority to U.S. Provisional Application No. 61/841,382, filed Jun. 30, 2013, and is entitled to benefit of that priority date. The specification, figures, appendices and complete disclosure of U.S. Provisional Application No. 61/841,382 are incorporated herein in their entireties by specific reference for all purposes.

FIELD OF INVENTION

This invention relates generally to oil and gas well drilling and production, and related operations. More particularly, this invention relates to a computer-implemented system for monitoring and managing data stream quality in well drilling and production operations.

BACKGROUND OF THE INVENTION

It is well-known that the drilling of an oil or gas well, and related operations, is responsible for a significant portion of the costs related to oil and gas exploration and production. In particular, as new wells are being drilled into remote or less-accessible reservoirs, the complexity, time and expense to drill a well have substantially increased.

Accordingly, it is critical that drilling operations be completed safely, accurately, and efficiently. With directional drilling techniques, and the greater depths to which wells are being drilled, many complexities are added to the drilling operation, and the cost and effort required to respond to a problem during drilling are high. This requires a high level of competence from the driller or drilling engineer at the drilling rig (or elsewhere) to safely drill the well as planned.

A "well plan" specifies a number of parameters for drilling a well, and is developed, in part, based on a geological model. A geological model of various subsurface formations is generated by a geologist from a variety of sources, including seismic studies, data from wells drilled in the area, core samples, and the like. A geological model typically includes depths to the various "tops" that define the formations (the term "top" generally refers to the top of a stratigraphic or biostratigraphic boundary of significance, a horizon, a fault, a pore pressure transition zone, change in rock type, or the like. Geological models usually include multiple tops, thereby defining the presence, geometry and composition of subsurface features.

The well plan specifies drilling parameters as the well bore advances through the various subsurface features. Parameters include, but are not limited to, mud weight, drill bit rotational speed, and weight on bit (WOB). The drilling operators rely on the well plan to anticipate tops and changes in subsurface features, account for drilling uncertainties, and adjust drilling parameters accordingly.

In many cases, the initial geological model may be inaccurate. The depth or location of a particular top may be off by a number of feet. Further, since some geological models recite distances based on the distance between two tops, an error in the absolute depth of one top can result in errors in the depths of multiple tops. Thus, a wellbore can advance into a high pressure subsurface formation before anticipated.

Such errors thus affect safety as well as cost and efficiency. It is fundamental in the art to use drilling "mud" circulating through the drill string to remove cuttings, lubricate the drill bit (and perhaps power it), and control the subsurface pressures. The drilling mud returns to the surface, where cuttings are removed, and is then recycled.

In some cases, the penetration of a high pressure formation can cause a sudden pressure increase (or "kick") in the wellbore. If not detected and controlled, a "blowout" can occur, which may result in failure of the well. Blowout preventers ("BOP") are well known in the art, and are used to protect drilling personnel and the well site from the effects of a blowout. A variety of systems and methods for BOP monitoring and testing are known in the art, including "Blowout Preventer Testing System and Method," U.S. Pat. No. 7,706,890, and "Monitoring the Health of Blowout Preventer," US 2012/0197527, both of which are incorporated herein in their entireties by specific reference for all purposes.

Conversely, if the mud weight is too heavy, or the wellbore advances into a particularly fragile or fractured formation, a "lost circulation" condition may result where drilling mud is lost into the formation rather than returning to the surface. This leads not only to the increased cost to replace the expensive drilling mud, but can also result in more serious problems, such as stuck drill pipe, damage to the formation or reservoir, and blowouts.

Similar problems and concerns arise during other well operations, such as running and cementing casing and tubulars in the wellbore, wellbore completions, or subsurface formation characterizations.

Drills strings and drilling operations equipment include a number of sensors and devices to measure, monitor and detect a variety of conditions in the wellbore, including, but not limited to, hole depth, bit depth, mud weight, choke pressure, and the like. This data can be generated in real-time, but can be enormous, and too voluminous for personnel at the drilling site to review and interpret in sufficient detail and time to affect the drilling operation. Some of the monitored data may be transmitted back to an engineer or geologist at a remote site, but the amount of data transmitted may be limited due to bandwidth limitations. Thus, not only is there a delay in processing due to transmission time, the processing and analysis of the data may be inaccurate due to missing or incomplete data. Drilling operations continue, however, even while awaiting the results of analysis (such as an updated geological model).

A real-time drilling monitor (RTDM) workstation is disclosed in "Drilling Rig Advisor Console," U.S. application Ser. No. 13/31,646, which is incorporated herein by specific reference for all purposes. The RTDM receives sensor signals from a plurality of sensors and generates single graphical user interface with dynamically generated parameters based on the sensor signals.

Likewise, an intelligent drilling advisor system is disclosed in "Intelligent Drilling Advisor," U.S. Pat. No. 8,121,971, which is incorporated herein by specific reference for all purposes. The intelligent advisor system comprises an information integration environment that accesses and configures software agents that acquire data from sensors at a drilling site, transmit that data to the information integration environment, and drive the drilling state and the drilling recommendations for drilling operations at the drilling site.

SUMMARY OF INVENTION

In various embodiments, the present invention comprises a well advisor system for monitoring and managing well drilling and production operations. The system may be accessed through one or more workstations, or other computing devices. A workstation comprises one or more computers or computing devices, and may be located at a well site or remotely. The system can be implemented on a single computer system, multiple computers, a computer server, a handheld computing device, a tablet computing device, a smart phone, or any other type of computing device.

The system is in communication with and receives input from various sensors. In general, the system collects real-time sensor data sampled during operations at the well site, which may include drilling operations, running casing or tubular goods, completion operations, or the like. The system processes the data, and provides nearly instantaneous numerical and visual feedback through a variety of graphical user interfaces ("GUIs").

The GUIs are populated with dynamically updated information, static information, and risk assessments, although they also may be populated with other types of information. The users of the system thus are able to view and understand a substantial amount of information about the status of the particular well site operation in a single view, with the ability to obtain more detailed information in a series of additional views.

In one embodiment, the system is installed at the well site, and thus reduces the need to transmit date to a remote site for processing. The well site can be an offshore drilling platform or land-based drilling rig. This reduces delays due to transmitting information to a remote site for processing, then transmitting the results of that processing back to the well site. It also reduces potential inaccuracies in the analysis due to the reduction in the data being transmitted. The system thus allows personnel at the well site to monitor the well site operation in real time, and respond to changes or uncertainties encountered during the operation. The response may include comparing the real time data to the current well plan, and modifying the well plan.

In yet another embodiment, the system is installed at a remote site, in addition to the well site. This permits users at the remote site to monitor the well-site operation in a similar manner to a user at the well-site installation.

In some exemplary embodiments, the system is a web-enabled application, and the system software may be accessed over a network connection such as the Internet. A user can access the software via the user's web browser. In some embodiments, the system performs all of the computations and processing described herein and only display data is transmitted to the remote browser or client for rendering screen displays on the remote computer. In another embodiment, the remote browser or software on the remote system performs some of the functionality described herein.

Sensors may be connected directly to the workstation at the well site, or through one or more intermediate devices, such as switches, networks, or the like. Sensors may comprise both surface sensors and downhole sensors. Surface sensors include, but are not limited to, sensors that detect torque, revolutions per minute (RPM), and weight on bit (WOB). Downhole sensors include, but are not limited to, gamma ray, pressure while drilling (PWD), and resistivity sensors. The surface and downhole sensors are sampled by the system during drilling or well site operations to provide information about a number of parameters. Surface-related parameters include, but are not limited to, the following: block position; block height; trip/running speed; bit depth; hole depth; lag depth; gas total; lithography percentage; weight on bit; hook load; choke pressure; stand pipe pressure; surface torque; surface rotary; mud motor speed; flow in; flow out; mud weight; rate of penetration; pump rate; cumulative stroke count; active mud system total; active mud system change; all trip tanks; and mud temperature (in and out). Downhole parameters include, but are not limited to, the following: all FEMWD; bit depth; hole depth; PWD annular pressure; PWD internal pressure; PWD EMW; PWD pumps off (min, max and average); drill string vibration; drilling dynamics; pump rate; pump pressure; slurry density; cumulative volume pumped; leak off test (LOT) data; and formation integrity test (FIT) data. Based on the sensed parameters, the system causes the processors or microprocessor to calculate a variety of other parameters, as described below.

In several embodiments, the system software comprises a database/server, a display or visualization module, one or more smart agents, one or more templates, and one or more "widgets." The database/server aggregates, distributes and manages real-time data being generated on the rig and received through the sensors. The display or visualization module implements a variety of GUI displays, referred to herein as "consoles," for a variety of well site operations. The information shown on a console may comprise raw data and calculated data in real time.

Templates defining a visual layout may be selected or created by a user to display information in some portions of or all of a console. In some embodiments, a template comprises an XML file. A template can be populated with a variety of information, including, but not limited to, raw sensor data, processed sensor data, calculated data values, and other information, graphs, and text. Some information may be static, while other information is dynamically updated in real time during the well site operation. In one embodiment, a template may be built by combining one or more display "widgets" which present data or other information. Smart agents perform calculations based on data generated through or by one or more sensors, and said calculated data can then be displayed by a corresponding display widgets.

In one exemplary embodiment, the system provides the user the option to implement a number of consoles corresponding to particular well site operations. In one embodiment, consoles include, but are not limited to, rig-site fluid management, BOP management, cementing, and casing running. A variety of smart agents and other programs are used by the consoles. Smart agents and other programs may be designed for use by a particular console, or may be used by multiple consoles. A particular installation of the system may comprise a single console, a sub-set of available consoles, or all available consoles.

Agents can be configured, and configuration files created or modified, using the agent properties display. The same properties are used for each agent, whether the agent configuration is created or imported. The specific configuration information (including, but not limited to, parameters, tables, inputs, and outputs) varies depending on the smart agent. Parameters represent the overall configuration of the agent, and include basic settings including, but not limited to, start and stop parameters, tracing, whether data is read to a log, and other basic agent information. Tables comprise information appearing in database tables associated with the agent. Inputs and outputs are the input or output mnemonics that are being tracked or reported on by the agent. For several embodiments, in order for data to be tracked or reported on, each output must have an associated output. This includes, but is not limited to, log and curve information.

In one embodiment, the system allows for the easy monitoring and evaluation in real time of the quality of various data streams generated during well-site drilling and production operations. It provides a variety of visible and audible signals to enable users to judge the quality and trustworthiness of the data being displayed in the various consoles. Particular data quality tests can be configured for selected data streams, and these tests can be applied to (i.e., subscribe to) the appropriate data streams (or curves) through the various consoles. The system can, for example, provide a visual data quality indicator together with the actual drilling or production data, in real time. The system further has the ability to configure a number of data quality monitors running at a number of rigs or well sites by providing a centralized management tool at a central location.

A variety of icons may be shown on the consoles to indicate data quality status. In one embodiment, the data quality indicator is based on the dynamic evaluation of data quality for a period of time. In one particular embodiment, the indicator is based on the last 30 minutes of data.

In several exemplary embodiments, a Data Quality widget aggregates the status of all subscribed curve tests and displays this as a single icon. A logic progression is used to create an aggregated status icon based on a set of curve or data set tests (which can be accessed via a Data Quality dashboard, as described below), where there is full or substantially full subscription in the Data Quality widget to the tests. It may also be used to create an aggregated status icon where there is not full subscription (e.g., a "not monitoring" status for at least one of the curves or data sets).

BRIEF DESCRIPTION OF THE DRAWINGS

FIG. 10 shows a table of Data Quality health indicators.

DETAILED DESCRIPTION OF EXEMPLARY EMBODIMENTS

Computing Environment Context

Figure 1:
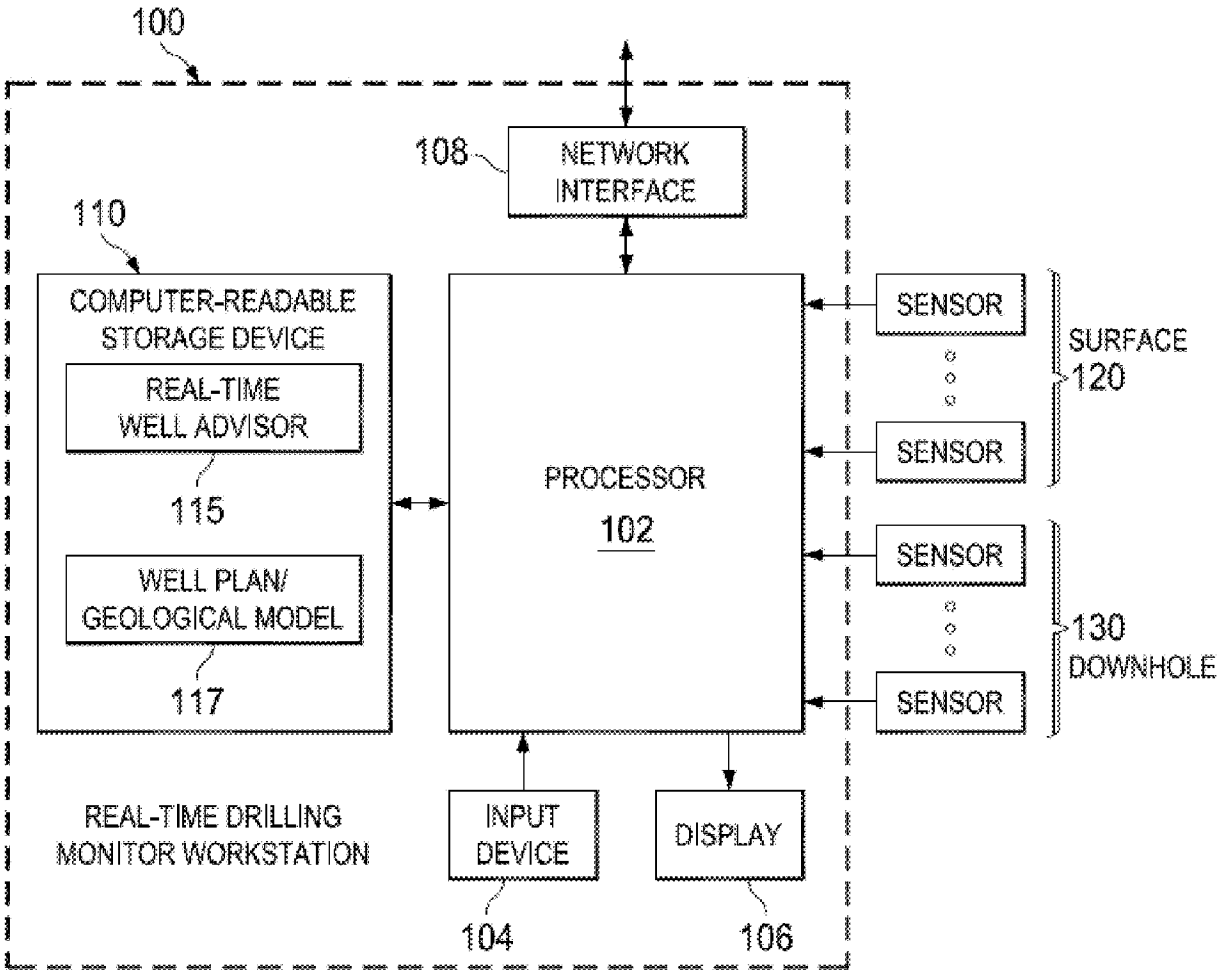
FIG. 1 shows a view of a system in accordance with an embodiment of the present invention.

The following discussion is directed to various exemplary embodiments of the present invention, particularly as implemented into a situationally-aware distributed hardware and software architecture in communication with one or more operating drilling rigs. However, it is contemplated that this invention may provide substantial benefits when implemented in systems according to other architectures, and that some or all of the benefits of this invention may be applicable in other applications. For example, while the embodiments of the invention may be described herein in connection with wells used for oil and gas exploration and production, the invention also is contemplated for use in connection with other wells, including, but not limited to, geothermal wells, disposal wells, injection wells, and many other types of wells. One skilled in the art will understand that the examples disclosed herein have broad application, and that the discussion of any particular embodiment is meant only to be exemplary of that embodiment, and not intended to suggest that the scope of the disclosure, including the claims, is limited to that embodiment.

In order to provide a context for the various aspects of the invention, the following discussion provides a brief, general description of a suitable computing environment in which the various aspects of the present invention may be implemented. A computing system environment is one example of a suitable computing environment, but is not intended to suggest any limitation as to the scope of use or functionality of the invention. A computing environment may contain any one or combination of components discussed below, and may contain additional components, or some of the illustrated components may be absent. Various embodiments of the invention are operational with numerous general purpose or special purpose computing systems, environments or configurations. Examples of computing systems, environments, or configurations that may be suitable for use with various embodiments of the invention include, but are not limited to, personal computers, laptop computers, computer servers, computer notebooks, hand-held devices, microprocessor-based systems, multiprocessor systems, TV set-top boxes and devices, programmable consumer electronics, cell phones, personal digital assistants (PDAs), network PCs, minicomputers, mainframe computers, embedded systems, distributed computing environments, and the like.

Embodiments of the invention may be implemented in the form of computer-executable instructions, such as program code or program modules, being executed by a computer or computing device. Program code or modules may include programs, objections, components, data elements and structures, routines, subroutines, functions and the like. These are used to perform or implement particular tasks or functions. Embodiments of the invention also may be implemented in distributed computing environments. In such environments, tasks are performed by remote processing devices linked via a communications network or other data transmission medium, and data and program code or modules may be located in both local and remote computer storage media including memory storage devices.

In one embodiment, a computer system comprises multiple client devices in communication with at least one server device through or over a network. In various embodiments, the network may comprise the Internet, an intranet, Wide Area Network (WAN), or Local Area Network (LAN). It should be noted that many of the methods of the present invention are operable within a single computing device.

A client device may be any type of processor-based platform that is connected to a network and that interacts with one or more application programs. The client devices each comprise a computer-readable medium in the form of volatile and/or nonvolatile memory such as read only memory (ROM) and random access memory (RAM) in communication with a processor. The processor executes computer-executable program instructions stored in memory. Examples of such processors include, but are not limited to, microprocessors, ASICs, and the like.

Client devices may further comprise computer-readable media in communication with the processor, said media storing program code, modules and instructions that, when executed by the processor, cause the processor to execute the program and perform the steps described herein. Computer readable media can be any available media that can be accessed by computer or computing device and includes both volatile and nonvolatile media, and removable and non-removable media. Computer-readable media may further comprise computer storage media and communication media. Computer storage media comprises media for storage of information, such as computer readable instructions, data, data structures, or program code or modules. Examples of computer-readable media include, but are not limited to, any electronic, optical, magnetic, or other storage or transmission device, a floppy disk, hard disk drive, CD-ROM, DVD, magnetic disk, memory chip, ROM, RAM, EEPROM, flash memory or other memory technology, an ASIC, a configured processor, CDROM, DVD or other optical disk storage, magnetic cassettes, magnetic tape, magnetic disk storage or other magnetic storage devices, or any other medium from which a computer processor can read instructions or that can store desired information. Communication media comprises media that may transmit or carry instructions to a computer, including, but not limited to, a router, private or public network, wired network, direct wired connection, wireless network, other wireless media (such as acoustic, RF, infrared, or the like) or other transmission device or channel. This may include computer readable instructions, data structures, program modules or other data in a modulated data signal such as a carrier wave or other transport mechanism. Said transmission may be wired, wireless, or both. Combinations of any of the above should also be included within the scope of computer readable media. The instructions may comprise code from any computer-programming language, including, for example, C, C++, C#, Visual Basic, Java, and the like.

Components of a general purpose client or computing device may further include a system bus that connects various system components, including the memory and processor. A system bus may be any of several types of bus structures, including, but not limited to, a memory bus or memory controller, a peripheral bus, and a local bus using any of a variety of bus architectures. Such architectures include, but are not limited to, Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computing and client devices also may include a basic input/output system (BIOS), which contains the basic routines that help to transfer information between elements within a computer, such as during start-up. BIOS typically is stored in ROM. In contrast, RAM typically contains data or program code or modules that are accessible to or presently being operated on by processor, such as, but not limited to, the operating system, application program, and data.

Client devices also may comprise a variety of other internal or external components, such as a monitor or display, a keyboard, a mouse, a trackball, a pointing device, touch pad, microphone, joystick, satellite dish, scanner, a disk drive, a CD-ROM or DVD drive, or other input or output devices. These and other devices are typically connected to the processor through a user input interface coupled to the system bus, but may be connected by other interface and bus structures, such as a parallel port, serial port, game port or a universal serial bus (USB). A monitor or other type of display device is typically connected to the system bus via a video interface. In addition to the monitor, client devices may also include other peripheral output devices such as speakers and printer, which may be connected through an output peripheral interface.

Client devices may operate on any operating system capable of supporting an application of the type disclosed herein. Client devices also may support a browser or browser-enabled application. Examples of client devices include, but are not limited to, personal computers, laptop computers, personal digital assistants, computer notebooks, hand-held devices, cellular phones, mobile phones, smart phones, pagers, digital tablets, Internet appliances, and other processor-based devices. Users may communicate with each other, and with other systems, networks, and devices, over the network through the respective client devices.

By way of further background, the term "software agent" refers to a computer software program or object that is capable of acting in a somewhat autonomous manner to carry out one or more tasks on behalf of another program or object in the system. Software agents can also have one or more other attributes, including mobility among computers in a network, the ability to cooperate and collaborate with other agents in the system, adaptability, and also specificity of function (e.g., interface agents). Some software agents are sufficiently autonomous as to be able to instantiate themselves when appropriate, and also to terminate themselves upon completion of their task.

The term "expert system" refers to a software system that is designed to emulate a human expert, typically in solving a particular problem or accomplishing a particular task. Conventional expert systems commonly operate by creating a "knowledge base" that formalizes some of the information known by human experts in the applicable field, and by codifying some type of formalism by way the information in the knowledge base applicable to a particular situation can be gathered and actions determined. Some conventional expert systems are also capable of adaptation, or "learning", from one situation to the next. Expert systems are commonly considered to be in the realm of "artificial intelligence."

The term "knowledge base" refers to a specialized database for the computerized collection, organization, and retrieval of knowledge, for example in connection with an expert system. The term "rules engine" refers to a software component that executes one or more rules in a runtime environment providing among other functions, the ability to: register, define, classify, and manage all the rules, verify consistency of rules definitions, define the relationships among different rules, and relate some of these rules to other software components that are affected or need to enforce one or more of the rules. Conventional approaches to the "reasoning" applied by such a rules engine in performing these functions involve the use of inference rules, by way of which logical consequences can be inferred from a set of asserted facts or axioms. These inference rules are commonly specified by means of an ontology language, and often a description language. Many reasoners use first-order predicate logic to perform reasoning; inference commonly proceeds by forward chaining and backward chaining.

The present invention may be implemented into an expert computer hardware and software system, implemented and operating on multiple levels, to derive and apply specific tools at a drilling site from a common knowledge base, including, but not limited to, information from multiple drilling sites, production fields, drilling equipment, and drilling environments. At a highest level, a knowledge base is developed from attributes and measurements of prior and current wells, information regarding the subsurface of the production fields into which prior and current wells have been or are being drilled, lithology models for the subsurface at or near the drilling site, and the like. In this highest level, an inference engine drives formulations (in the form of rules, heuristics, calibrations, or a combination thereof) based on the knowledge base and on current data. An interface to human expert drilling administrators is provided for verification of these rules and heuristics. These formulations pertain to drilling states and drilling operations, as well as recommendations for the driller, and also include a trendologist function that manages incoming data based on the quality of that data, such management including the amount of processing and filtering to be applied to such data, as well as the reliability level of the data and of calculations therefrom.

At another level, an information integration environment is provided that identifies the current drilling sites, and drilling equipment and processes at those current drilling sites. Based upon that identification, and upon data received from the drilling sites, servers access and configure software agents that are sent to a host client system at the drilling site; these software agents operate at the host client system to acquire data from sensors at the drilling site, to transmit that data to the information integration environment, and to derive the drilling state and drilling recommendations for the driller at the drilling site. These software agents include one or more rules, heuristics, or calibrations derived by the inference engine, and called by the information integration environment. In addition, the software agents sent from the information integration environment to the host client system operate to display values, trends, and reliability estimates for various drilling parameters, whether measured or calculated.

The information integration environment is also operative to receive input from the driller via the host client system, and to act as a knowledge base server to forward those inputs and other results to the knowledge base and the inference engine, with verification or input from the drilling administrators as appropriate.

According to another aspect of the invention, the system develops a knowledge base from attributes and measurements of prior and current wells, and from information regarding the subsurface of the production fields into which prior and current wells have been or are being drilled. According to this aspect of the invention, the system self-organizes and validates historic, real time, and/or near real time depth or time based measurement data, including information pertaining to drilling dynamics, earth properties, drilling processes and driller reactions. This drilling knowledge base suggests solutions to problems based on feedback provided by human experts, learns from experience, represents knowledge, instantiates automated reasoning and argumentation for embodying best drilling practices.

According to yet another aspect of the invention, the system includes the capability of virtualizing information from a well being drilled into a collection of metalayers, such metalayers corresponding to a collection of physical information about the layer (material properties, depths at a particular location, and the like) and also information on how to successfully drill through such a layer, such metalayers re-associating as additional knowledge is acquired, to manage real-time feedback values in optimizing the drilling operation, and in optimizing the driller response to dysfunction. Normalization into a continuum, using a system of such metalayers, enables real-time reaction to predicted downhole changes that are identified from sensor readings.

According to another aspect of the invention, the system is capable of carrying out these functions by creating and managing a network of software agents that interact with the drilling environment to collect and organize information for the knowledge base, and to deliver that information to the knowledge base. The software agents in this network are persistent, autonomous, goal-directed, sociable, reactive, non-prescriptive, adaptive, heuristic, distributed, mobile and self-organizing agents for directing the driller toward drilling optimization, for collecting data and information, and for creating dynamic transitional triggers for metalayer instantiation. These software entities interact with their environment through an adaptive rule-base to intelligently collect, deliver, adapt and organize information for the drilling knowledge base. According to this aspect of the invention, the software agents are created, modified and destroyed as needed based on the situation at the drilling rig, within the field, or at any feasible knowledge collection point or time instance within the control scope of any active agent.

According to another aspect of the invention, the software agents in the network of agents are controlled by the system to provide the recommendations to the drillers, using one or more rules, heuristics, and calibrations derived from the knowledge base and current sensor signals from the drilling site, and as such in a situationally aware manner. In this regard, the software agents interact among multiple software servers and hardware states in order to provide recommendations that assist human drillers in the drilling of a borehole into the earth at a safely maximized drilling rate. The software "experts" dispatch agents, initiate transport of remote memory resources, and provide transport of knowledge base components including rules, heuristics, and calibrations according to which a drilling state or drilling recommendation is identified responsive to sensed drilling conditions in combination with a selected parameter that is indicative of a metalayer of the earth, and in combination with selected minimums and maximums of the drilling equipment sensor parameters. The software experts develop rules, heuristics, and calibrations applicable to the drilling site derived from the knowledge base that are transmitted via an agent to a drilling advisor application, located at the drilling site, that is coupled to receive signals from multiple sensors at the drilling site, and also to one or more servers that configure and service multiple software agents.

According to another aspect of the invention, the system is applied to circulation actors to optimize circulation, hydraulics at the drill bit point of contact with the medium being drilled, rationalization of distributed pressure and temperature measurements and to provide recommendations to avoid or recover from loss of circulation events.

In addition, while this invention is described in connection with a multiple level hardware and software architecture system, in combination with drilling equipment and human operators, it is contemplated that several portions and facets of this invention are separately and independently inventive and beneficial, whether implemented in this overall system environment or if implemented on a stand-alone basis or in other system architectures and environments. Those skilled in the art having reference to this specification are thus directed to consider this description in such a light.

Well Advisor System and Consoles

FIG. 1 illustrates a workstation showing a well advisor system 100 in accordance with various exemplary embodiments of the present invention. The workstation comprises one or more computers or computing devices, and may be located at a well site or remotely. The system can be implemented on a single computer system, multiple computers, a computer server, a handheld computing device, a tablet computing device, a smart phone, or any other type of computing device.

The system is in communication with and receives input from various sensors 120, 130. In general, the system collects real-time sensor data sampled during operations at the well site, which may include drilling operations, running casing or tubular goods, completion operations, or the like. The system processes the data, and provides nearly instantaneous numerical and visual feedback through a variety of graphical user interfaces (GUIs).

The GUIs are populated with dynamically updated information, static information, and risk assessments, although they also may be populated with other types of information, as described below. The users of the system thus are able to view and understand a substantial amount of information about the status of the particular well site operation in a single view, with the ability to obtain more detailed information in a series of additional views.

In one embodiment, the system is installed at the well site, and thus reduces the need to transmit date to a remote site for processing. The well site can be an offshore drilling platform or land-based drilling rig. This reduces delays due to transmitting information to a remote site for processing, then transmitting the results of that processing back to the well site. It also reduces potential inaccuracies in the analysis due to the reduction in the data being transmitted. The system thus allows personnel at the well site to monitor the well site operation in real time, and respond to changes or uncertainties encountered during the operation. The response may include comparing the real time data to the current well plan, and modifying the well plan.

In yet another embodiment, the system is installed at a remote site, in addition to the well site. This permits users at the remote site to monitor the well-site operation in a similar manner to a user at the well-site installation.

The architecture of the system workstation shown in FIG. 1 is only one example of multiple possible architectures. In one embodiment, the workstation comprises one or more processors or microprocessors 102 coupled to one or more input devices 104 (e.g., mouse, keyboard, touchscreen, or the like), one or more output devices 106 (e.g., display, printer, or the like), a network interface 108, and one or more non-transitory computer-readable storage devices 110. In some embodiments, the input and output devices may be part of the workstation itself, while in other embodiment such devices may be accessible to the workstation through a network or other connection.

In one exemplary embodiment, the network interface may comprise a wire-based interface (e.g., Ethernet), or a wireless interface (e.g., BlueTooth, wireless broadband, IEEE 802.11x WiFi, or the like), which provides network connectivity to the workstation and system to enable communications across local and/or wide area networks. For example, the workstation can receive portions of or entire well or cementing plans or geological models 117 from a variety of locations.

The storage devices 110 may comprise both non-volatile storage devices (e.g., flash memory, hard disk drive, or the like) and volatile storage devices (e.g., RAM), or combinations thereof. The storage devices store the system software 115 which is executable by the processors or microprocessors to perform some or all of the functions describe below. The storage devices also may be used to store well plans, geological models 117, configuration files and other data.

In some exemplary embodiments, the system is a web-enabled application, and the system software may be accessed over a network connection such as the Internet. A user can access the software via the user's web browser. In some embodiments, the system performs all of the computations and processing described herein and only display data is transmitted to the remote browser or client for rendering screen displays on the remote computer. In other embodiments, the remote browser or software on the remote system performs some of the functionality described herein.

Sensors 120, 130 may be connected directly to the workstation at the well site, or through one or more intermediate devices, such as switches, networks, or the like. Sensors may comprise both surface sensors 120 and downhole sensors 130. Surface sensors include, but are not limited to, sensors that detect torque, revolutions per minute (RPM), and weight on bit (WOB). Downhole sensors include, but are not limited to, gamma ray, pressure while drilling (PWD), and resistivity sensors. The surface and downhole sensors are sampled by the system during drilling or well site operations to provide information about a number of parameters. Surface-related parameters include, but are not limited to, the following: block position; block height; trip/running speed; bit depth; hole depth; lag depth; gas total; lithography percentage; weight on bit; hook load; choke pressure; stand pipe pressure; surface torque; surface rotary; mud motor speed; flow in; flow out; mud weight; rate of penetration; pump rate; cumulative stroke count; active mud system total; active mud system change; all trip tanks; and mud temperature (in and out). Downhole parameters include, but are not limited to, the following: all FEMWD; bit depth; hole depth; PWD annular pressure; PWD internal pressure; PWD EMW; PWD pumps off (min, max and average); drill string vibration; drilling dynamics; pump rate; pump pressure; slurry density; cumulative volume pumped; leak off test (LOT) data; and formation integrity test (FIT) data. Based on the sensed parameters, the system causes the processors or microprocessor to calculate a variety of other parameters, as described below.

Figure 2:
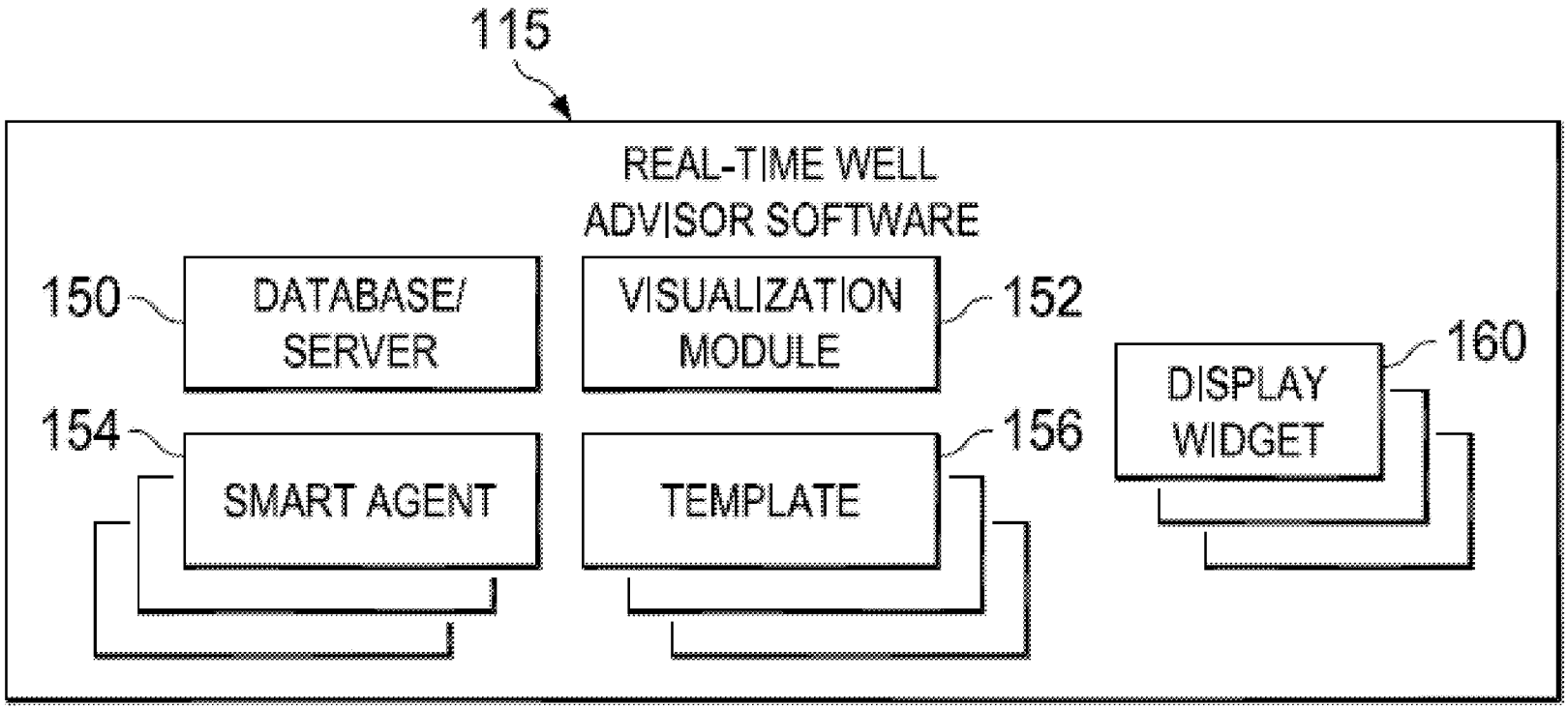
FIG. 2 shows a software architecture in accordance with various embodiments of the present invention.

FIG. 2 provides an example of the system software architecture. The system software comprises a database/server 150, a display or visualization module 152, one or more smart agents 154, one or more templates 156, and one or more "widgets" 160. The database/server 150 aggregates, distributes and manages real-time data being generated on the rig and received through the sensors. The display or visualization module 152 implements a variety of graphical user interface displays, referred to herein as "consoles," for a variety of well site operations. The information shown on a console may comprise raw data and calculated data in real time.

Templates 156 defining a visual layout may be selected or created by a user to display information in some portions of or all of a console. In some embodiments, a template comprises an XML file. A template can be populated with a variety of information, including, but not limited to, raw sensor data, processed sensor data, calculated data values, and other information, graphs, and text. Some information may be static, while other information is dynamically updated in real time during the well site operation. In one embodiment, a template may be built by combining one or more display "widgets" 160 which present data or other information. Smart agents 154 perform calculations based on data generated through or by one or more sensors, and said calculated data can then be displayed by a corresponding display widgets.

In one exemplary embodiment, the system provides the user the option to implement a number of consoles corresponding to particular well site operations. In one embodiment, consoles include, but are not limited to, rig-site fluid management, BOP management, cementing, and casing running. A variety of smart agents and other programs are used by the consoles. Smart agents and other programs may be designed for use by a particular console, or may be used by multiple consoles. A particular installation of the system may comprise a single console, a sub-set of available consoles, or all available consoles.

Figure 3:
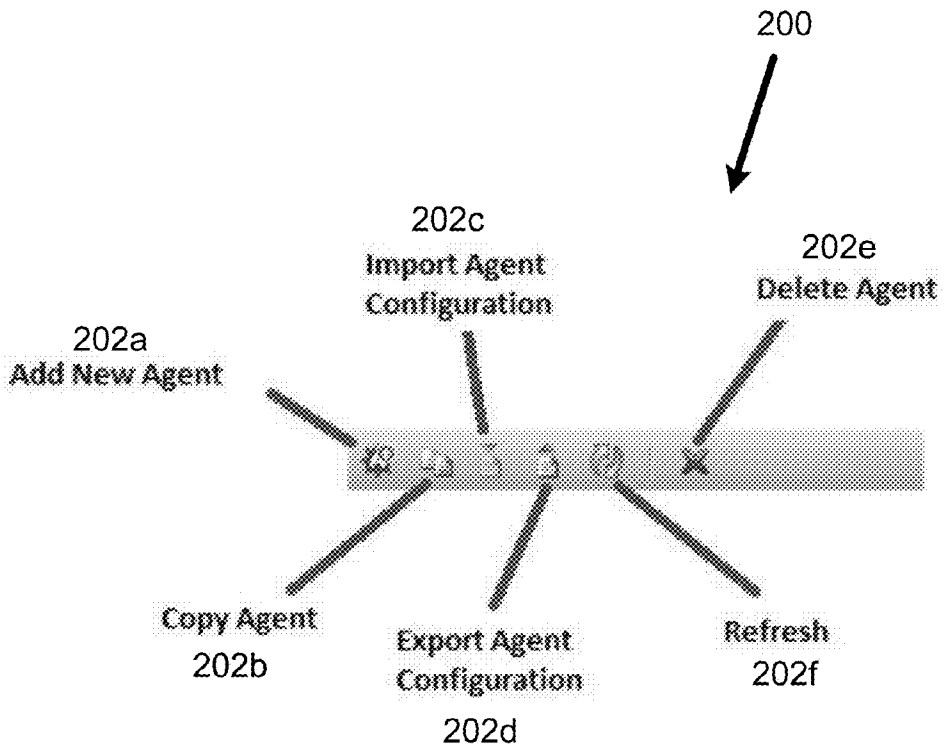
FIG. 3 shows a smart agent management toolbar.
Figure 4:
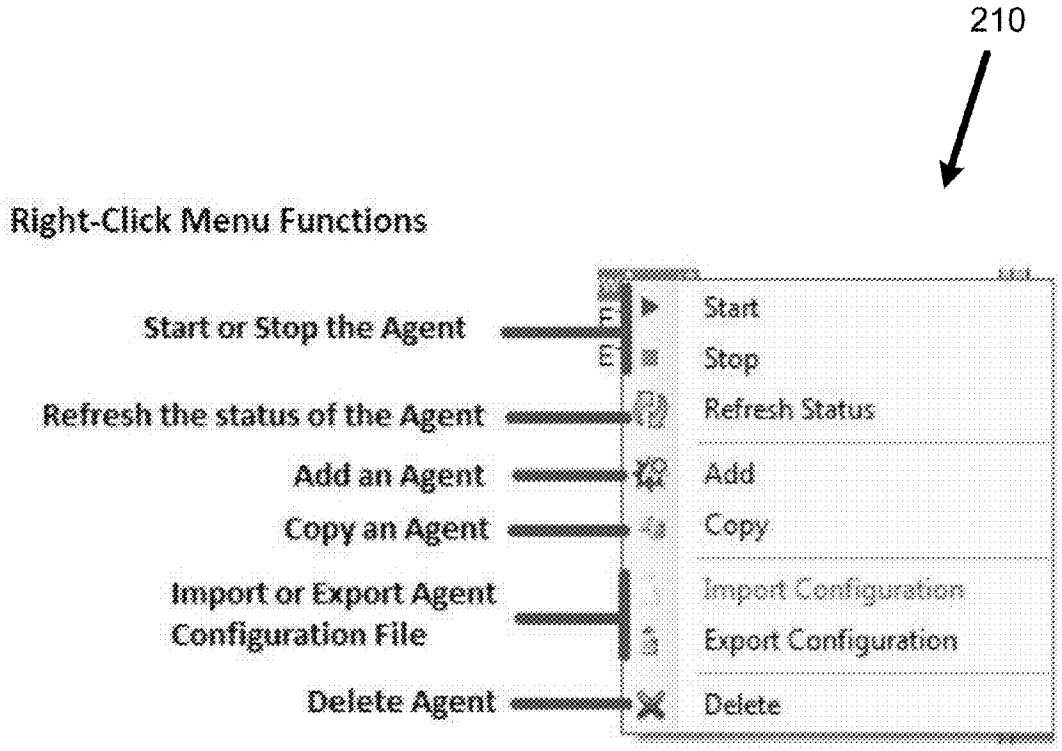
FIG. 4 shows a smart agent management menu.

In various embodiments, smart agents in the system can be managed with a toolbar 200 (as seen in FIG. 3) or by a drop-down menu 210 (as seen in FIG. 4), which may be activated by clicking on a smart agent icon, right-click on a mouse button, or the like. Functions include, but are not limited to, adding a new agent 202*a*, copying an agent configuration 202*b*, importing 202*c* or exporting 202*d* an agent configuration file, deleting an agent 202*e*, refreshing the status of an agent 202*f*, or starting or stopping an agent.

Figure 5:
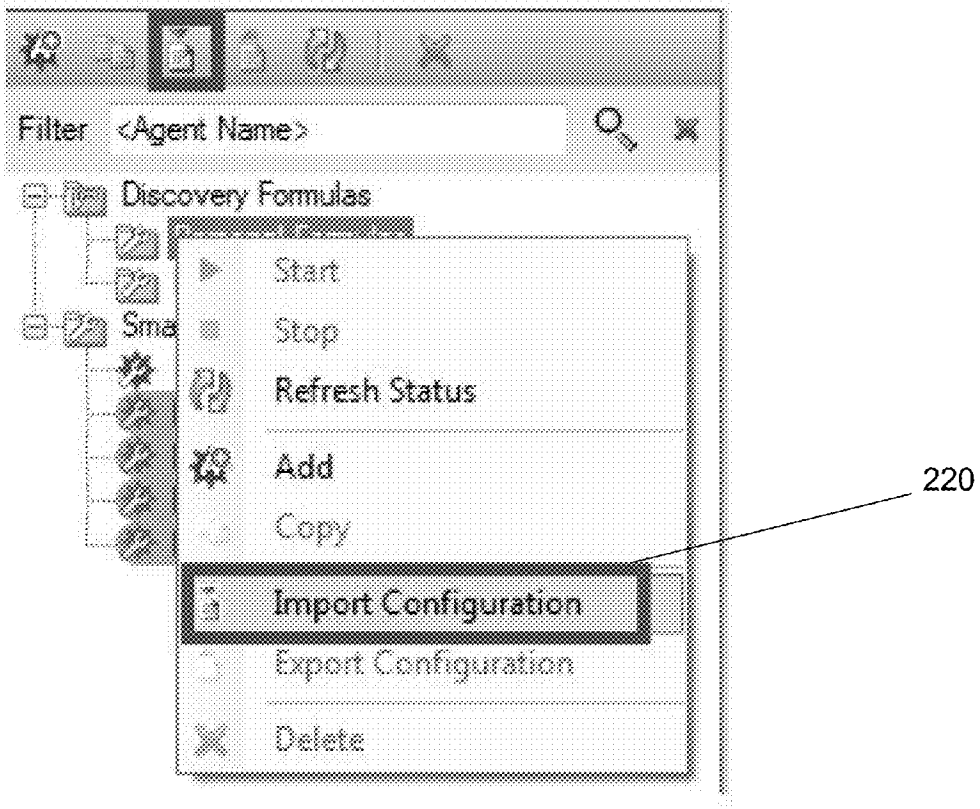
FIG. 5 shows a smart agent configuration file import menu.

For certain smart agents, an agent configuration file must be imported 220 to use the smart agent, as seen in FIG. 5. In one embodiment, configuration files are denominated as *.agent files. Selecting the import option provides the user the option to enter the configuration file name, or browse to a location where the configuration file is stored.

Figure 6:
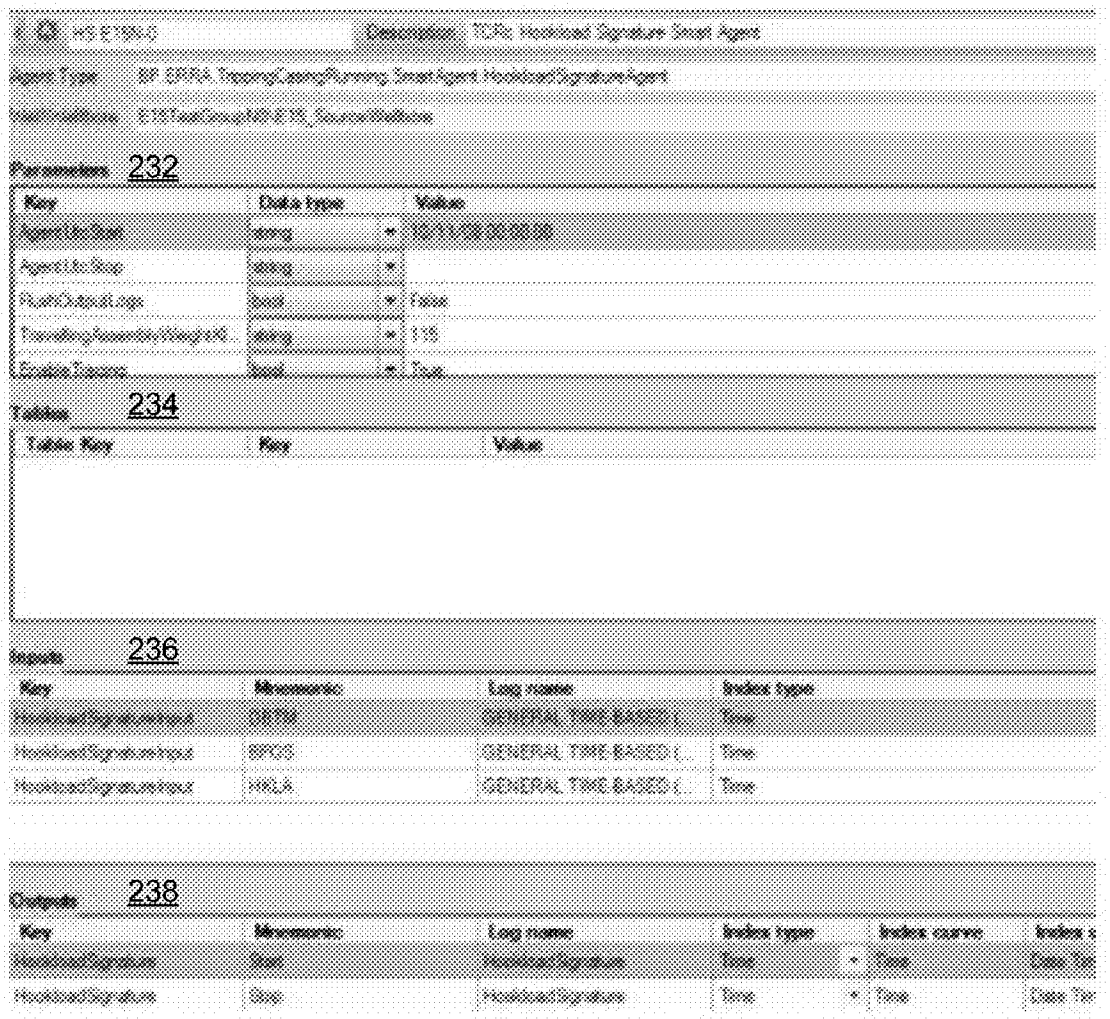
FIG. 6 shows a smart agent configuration display screen.

Agents can be configured, and configuration files created or modified, using the agent properties display, as seen in FIG. 6. The same properties are used for each agent, whether the agent configuration is created or imported. The specific configuration information (including, but not limited to, parameters, tables, inputs, and outputs) varies depending on the smart agent. Parameters 232 represent the overall configuration of the agent, and include basic settings including, but not limited to, start and stop parameters, tracing, whether data is read to a log, and other basic agent information. Tables 234 comprise information appearing in database tables associated with the agent. Inputs 236 and outputs 238 are the input or output mnemonics that are being tracked or reported on by the agent. For several embodiments, in order for data to be tracked or reported on, each output must have an associated output. This includes, but is not limited to, log and curve information.

Figure 7:
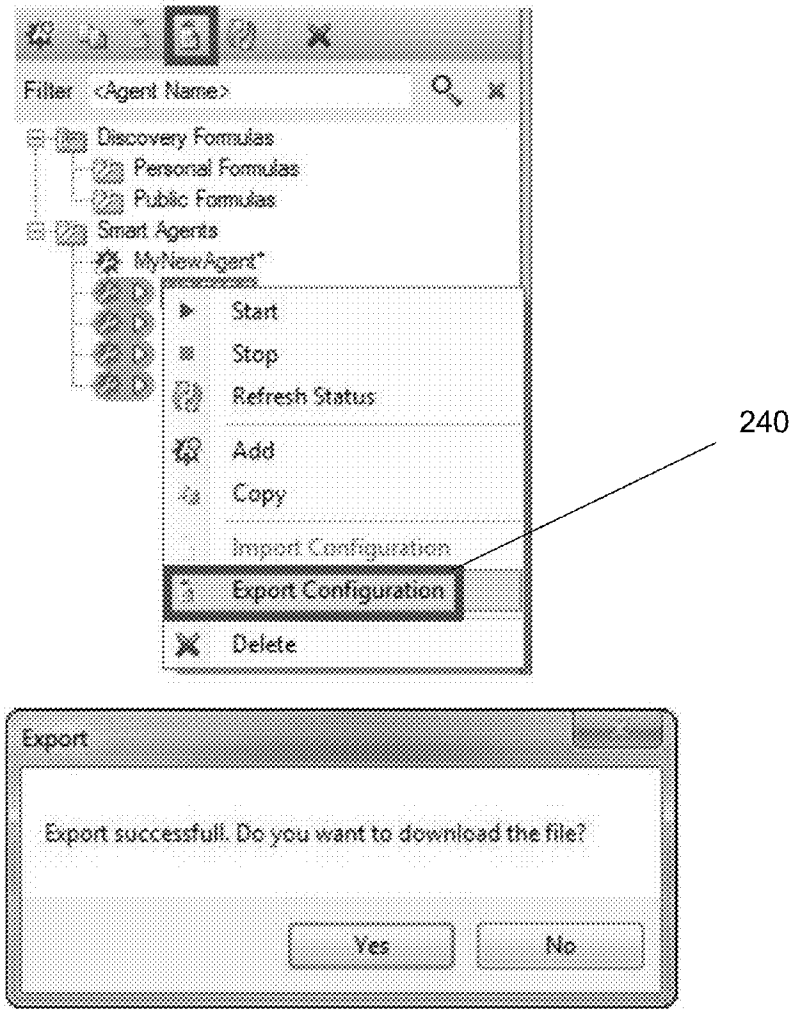
FIG. 7 shows a smart agent configuration file export menu.
Figure 8:
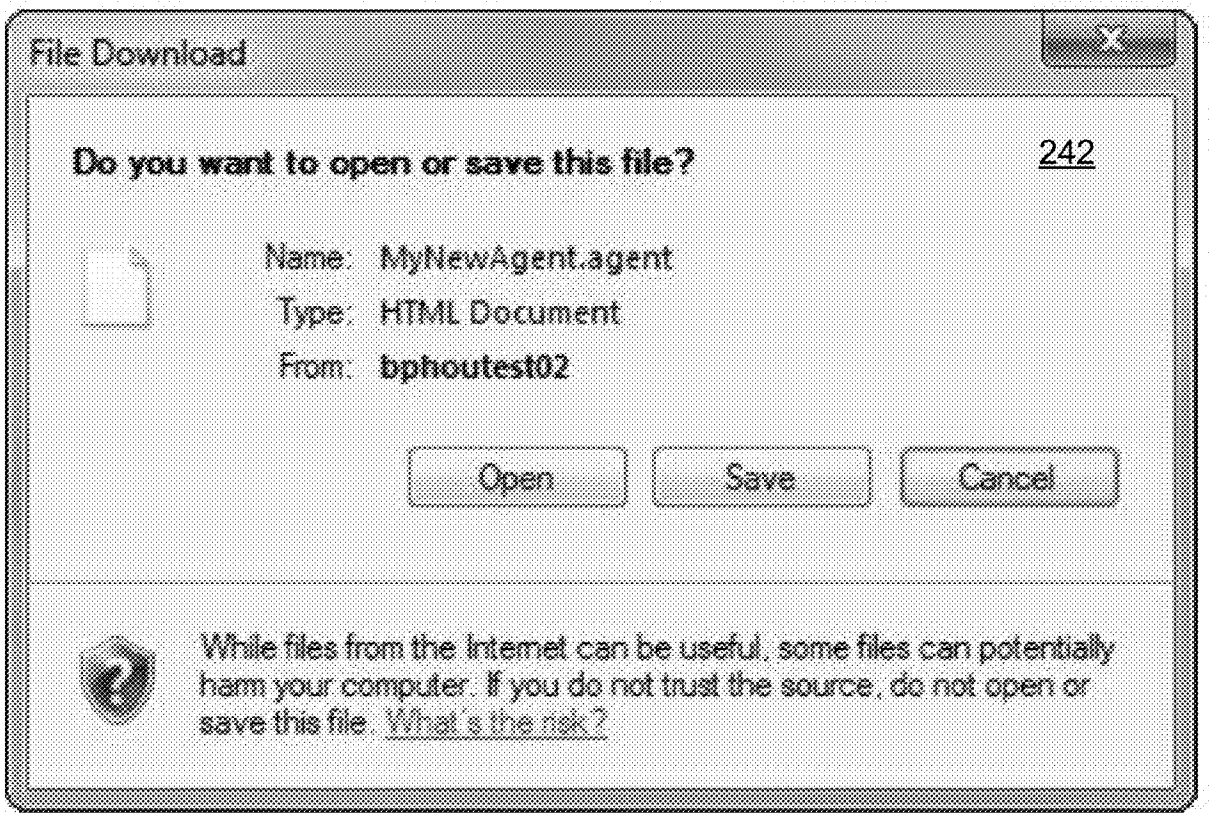
FIG. 8 shows a smart agent configuration file download display screen.

Users can export an agent configuration file for other users to import and use. The export configuration button in the toolbar can be used for a selected agent, or the agent can be right-clicked on and the export configuration option 240 chosen, as shown in FIG. 7. The user confirms 242 the action to download the file to a local hard drive or other file storage location, as seen in FIG. 8. The user may name the file as desired. Once downloaded, the file can be copied, emailed, or otherwise transferred to another user for importation and use.

Figure 9:
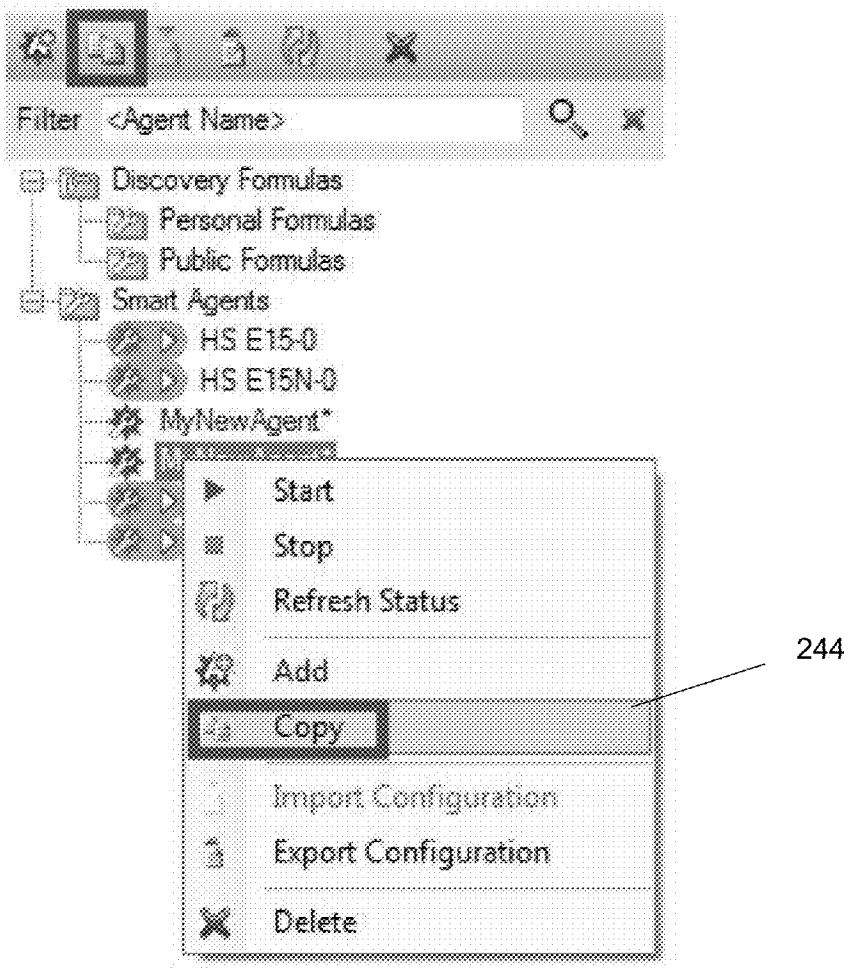
FIG. 9 shows a smart agent configuration file copy menu.

Copying an agent configuration 244, as seen in FIG. 9, allows the user to copy an agent configuration file and rename it. This saves the user from having to perform an initial setup of the agent properties or create a new configuration file multiple times, if the user has agent configurations that are similar. In one embodiment, the user right clicks on the desired agent, selects the copy option, and identifies the wellbore for which the configuration is to be used. The user can name or rename the new agent configuration.

Data Quality Monitoring

The Data Quality system allows for the easy monitoring and evaluation in real time of the quality of various data streams generated during well-site drilling and production operations. It provides a variety of visible and audible signals to enable users to judge the quality and trustworthiness of the data being displayed in the various consoles. Particular data quality tests can be configured for selected data streams, and these tests can be applied to (i.e., subscribe to) the appropriate data streams (or curves) through the various consoles. The system can, for example, provide a visual data quality indicator together with the actual drilling or production data, in real time. The system further has the ability to configure a number of data quality monitors running at a number of rigs or well sites by providing a centralized management tool at a central location.

Thus, for example, if Curve A is being used in a console, the user would typically configure a set of tests for Curve A, then would subscribe to alerts being produced by these tests through the Data Quality system. If there are alerts associated with Curve A, the user can determine whether or not it is risky to make drilling or operations decisions based on Curve A, since it may have problems with data quality.

A variety of icons may be shown on the consoles to indicate data quality status. A table of exemplary icons or health indicators is shown in FIG. 10. These indicators include the following:

"Red X" 302—Used to indicate when data quality control tests are not configured or are not running.

"Green Circle" 304—Used to indicate that the system has not detected any alerts for the configured test(s) or curves(s).

"Green Circle with Red X" 306—Used to indicate that the system has not detected any alerts for the configured test(s) or curves(s) that are running, but there is a configuration problem for one or more of the configured test(s) or curve(s). This means that the user may not have the full picture of the situation since some of the tests may have a configuration problem.

"Green Circle with i" 308—Used to indicate that the system has not detected any alerts for the configured test(s) or curves(s) that are running, but there has been at least one active alert within the last half-hour (or other selected time period).

"Yellow Triangle" 310—Used to indicate that the system has detected at least one alert with medium severity for the configured test(s) or curves(s).

"Yellow Triangle with Red X" 312—Used to that the system has detected at least one alert with medium severity for the configured test(s) or curves(s), and that, in addition, there is a configuration problem for one or more of the configured test(s) or curve(s).

"Red Triangle with !" 314—Used to indicate that the system has detected at least one alert with high severity for the configured test(s) or curves(s).

"Red Triangle with ! and Red X" 316—Used to that the system has detected at least one alert with high severity for the configured test(s) or curves(s), and that, in addition, there is a configuration problem for one or more of the configured test(s) or curve(s).

In one embodiment, the data quality indicator is based on the dynamic evaluation of data quality for a period of time. For example, the indicator may be based on the last 30 minutes of data.

Figure 11:
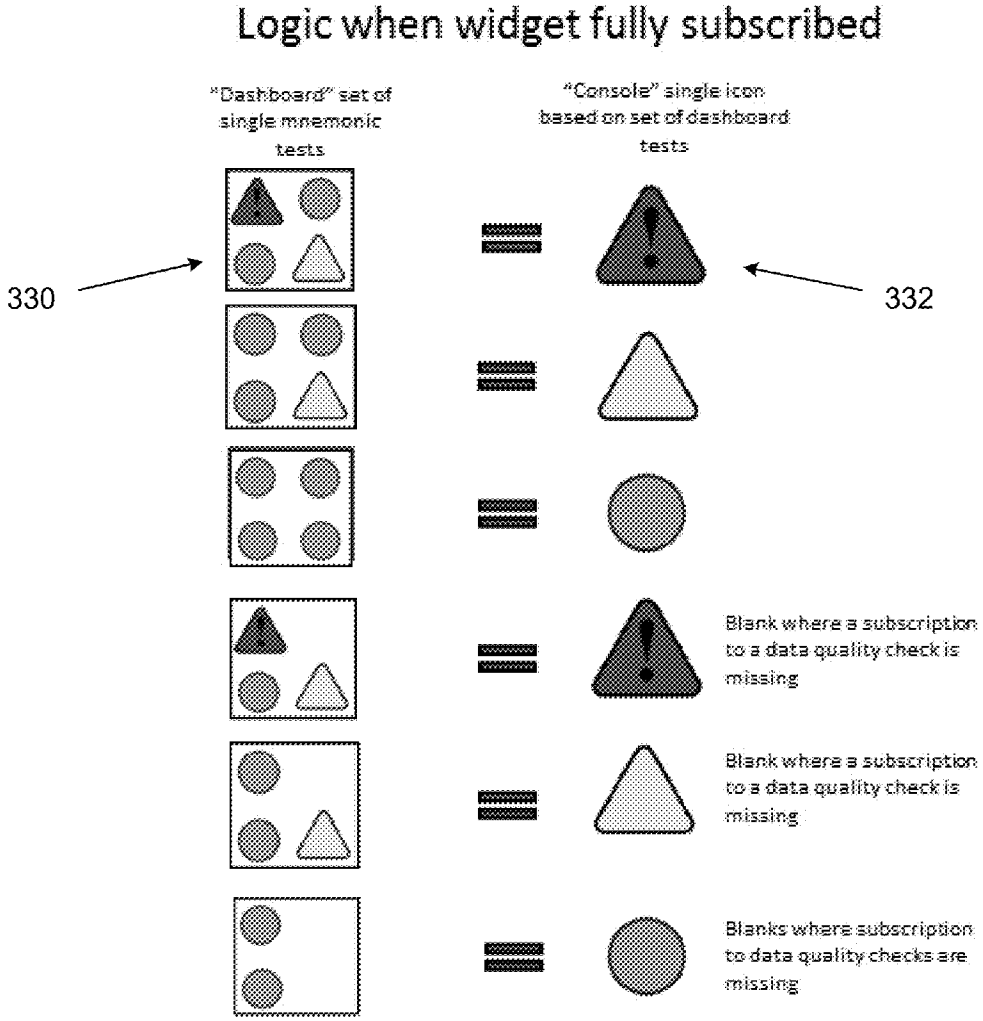
FIG. 11 shows a table of aggregated Data Quality indicators where there is full subscription.

In several exemplary embodiments, a Data Quality widget aggregates the status of multiple or all subscribed curve tests and displays this as a single icon. FIG. 11 shows an example of the logic or rules used to create an aggregated status icon based on a set of curve or data set tests (which can be accessed via a Data Quality dashboard, as described below), where there is full or substantially full subscription in the Data Quality widget to the tests. For example, the general rule is that the aggregated status icon matches the highest alert status in the group of tests. Thus, a group of tests with a high severity alert 330 results in an aggregated high severity alert status icon 332. Blanks may be shown in the set of tests to indicate where a subscription to a data quality check is missing.

Figure 12:
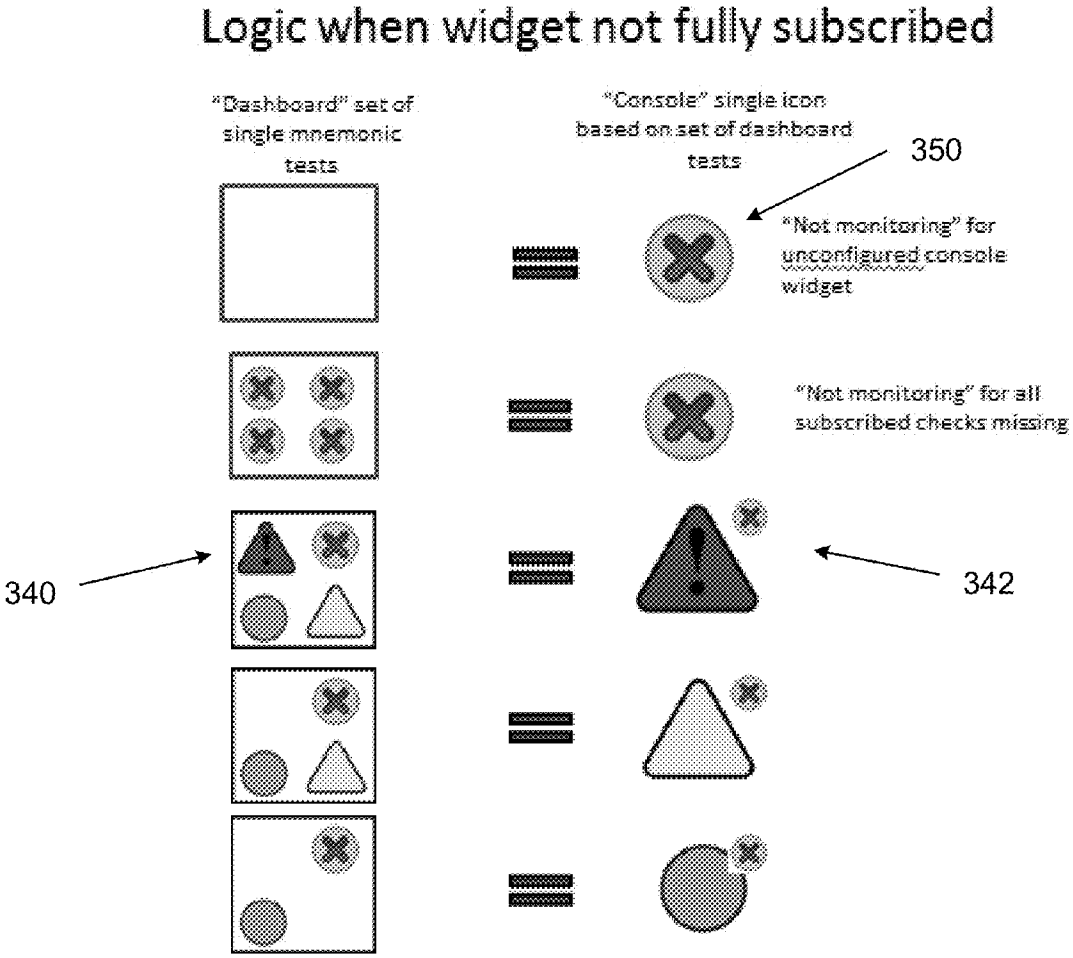
FIG. 12 shows a table of aggregated Data Quality indicators where there is not full subscription.

FIG. 12 shows an example of the logic or rules used to create an aggregated status icon where there is not full subscription (e.g., the red "X" in the grey circle indicates a "not monitoring" status for at least one of the curves or data sets). As above, the general rule is that the aggregated status icon 342 matches the highest alert status in the group of tests 340, but with the addition of a red "X" in a grey circle. If the set of tests is entirely in a "not monitoring" state for a unconfigured console widget, or for all subscribed checks missing, the red "X" icon 350 is used for the aggregate.

Figure 13:
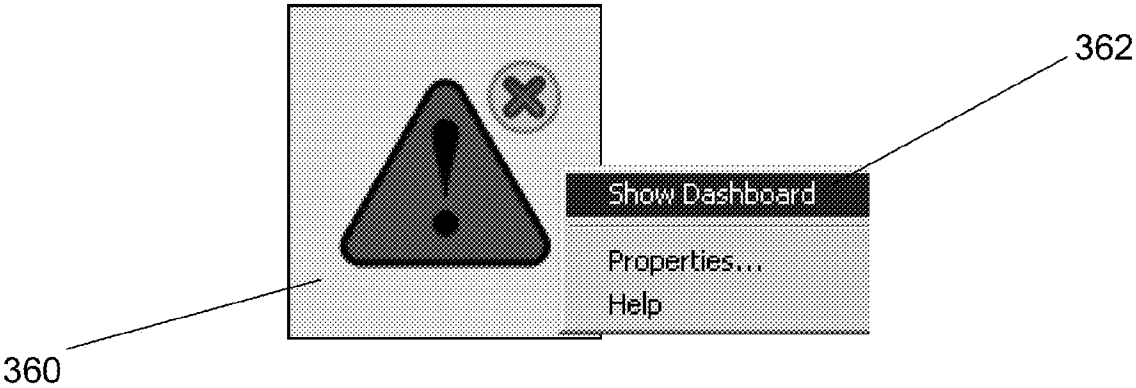
FIG. 13 shows an example of a show dashboard menu option.
Figure 14:
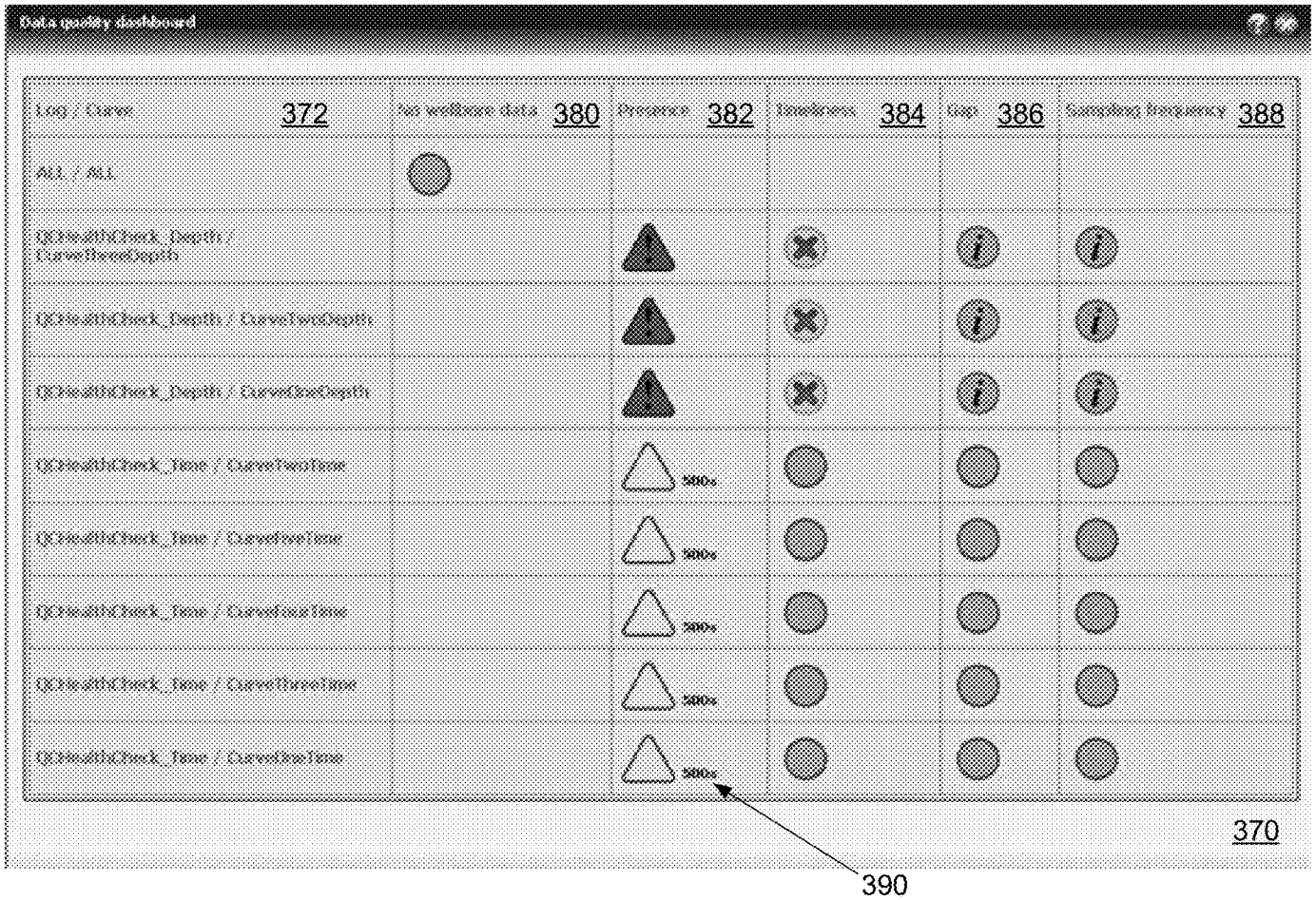
FIG. 14 shows an example of a Data Quality dashboard screen.
Figure 15:
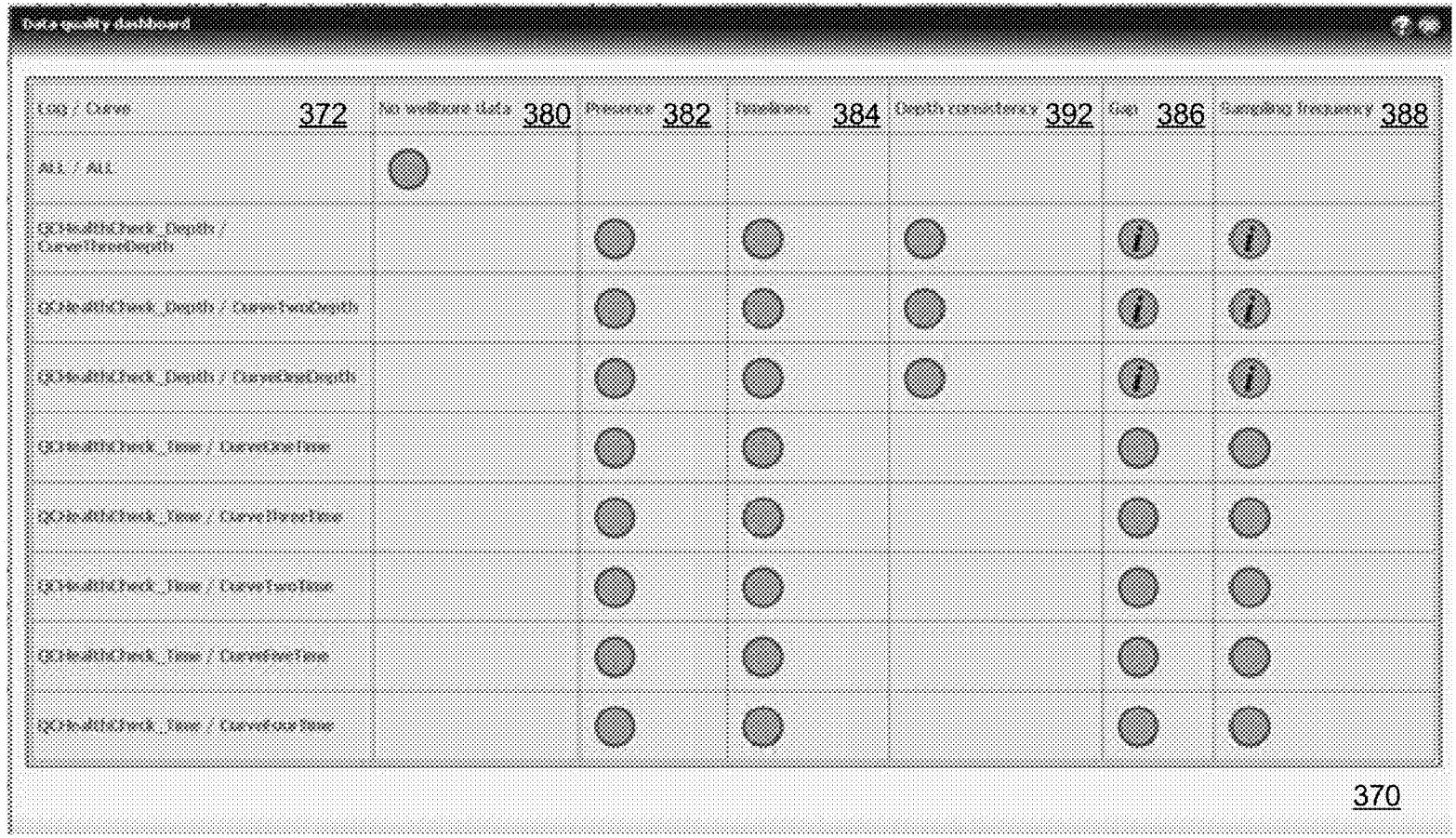
FIG. 15 shows another example of a Data Quality dashboard screen.

The user can access a Data Quality dashboard by double clicking or right clicking on a data quality icon 360, such as the aggregated Data Quality widget icon, and selecting "Show Dashboard" 362, as seen in FIG. 13. This brings up the Data Quality dashboard 370, examples of which are shown in FIGS. 14 and 15, which displays detailed information for the individual curves, logs or data being tested 372. In the embodiments shown, these tests include the following: no wellbore data 380, presence 382, timeliness 384, gap 386, sampling frequency 388, and depth consistency 392. Appropriate data indicators are shown where information is available. A breached threshold also can be shown next to the particular health indicator or icon. For example, FIG. 14 shows that the presence alert for the time curve has been triggered because the curve has been away for more than 500 seconds, as indicated by the "500 s" 390 next to the warning indicators.

Figure 16:
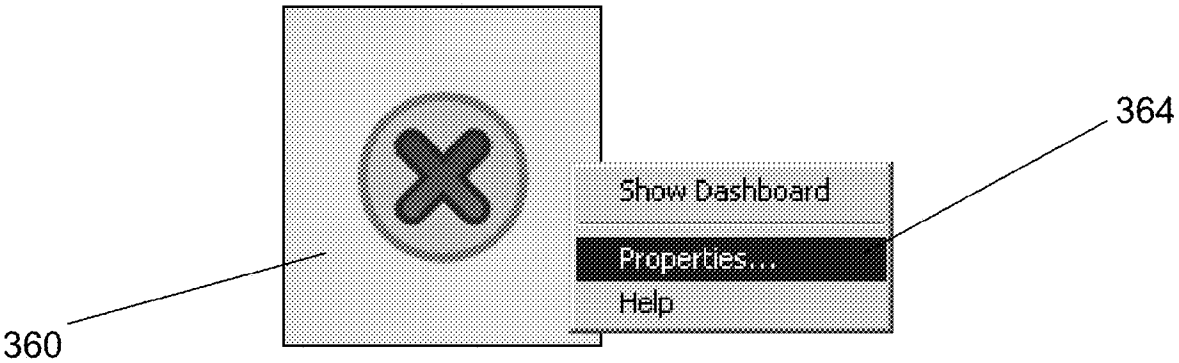
FIG. 16 shows an example of a properties menu option.

The user can subscribe to or select particular data quality tests by double clicking or right clicking on a data quality icon 360, such as the aggregated Data Quality widget icon, and selecting "Properties" 364, as shown in FIG. 16. This brings up the data quality properties window 400, as seen in FIG. 17, where the user can select the data quality tests 402 from which the user wishes to see or receive alerts.

Figure 17:
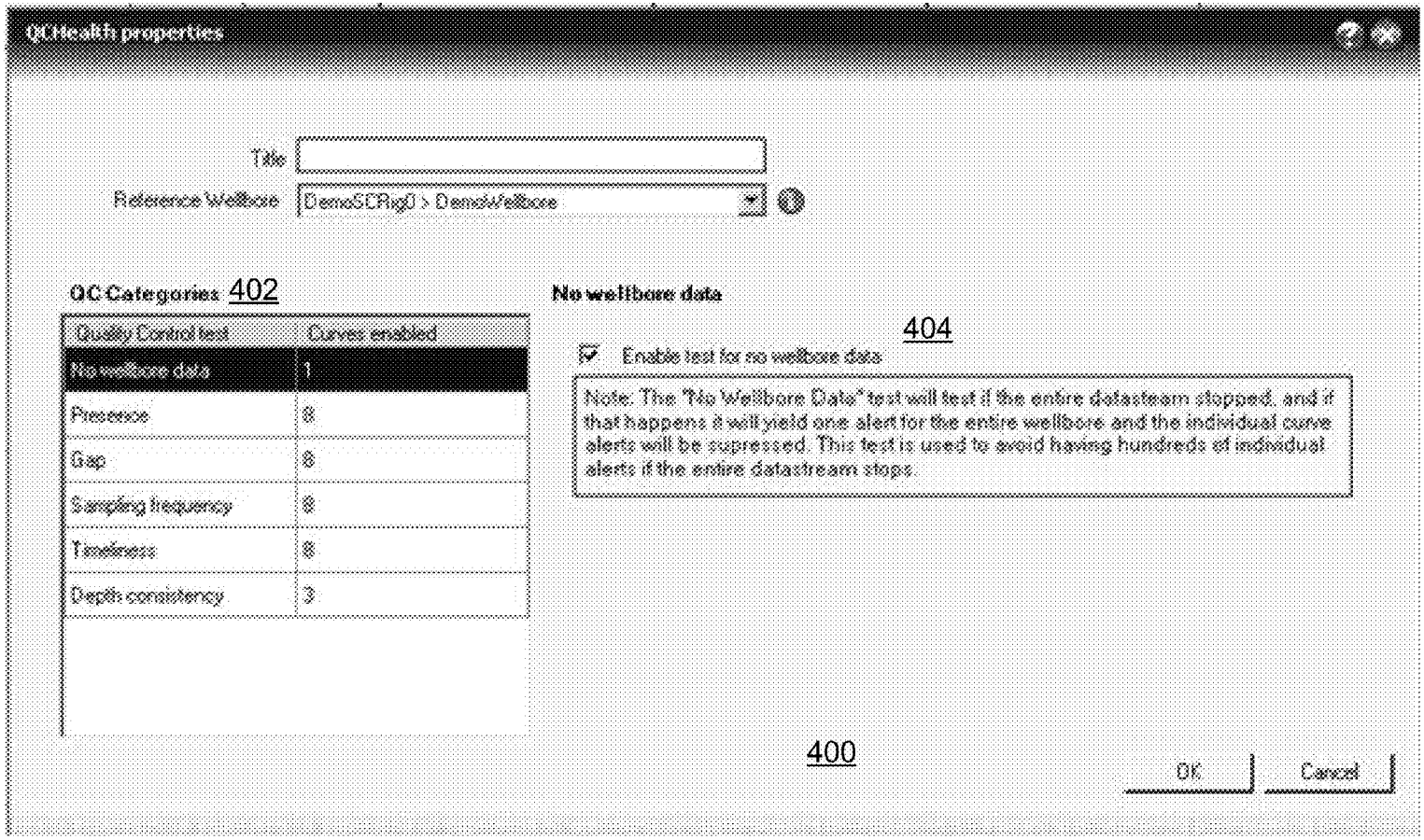
FIG. 17 shows an example of a Data Quality properties window with "No Wellbore Date" test option.

The "No Wellbore Data" test 404, which is the highlighted test seen in FIG. 17, determines whether the entire data stream has stopped or been lost for a particular wellbore, as indicated by the description of the test shown to the user. The system will, for any time-indexed curve used in the configuration, define a strict threshold. In one embodiment, this threshold is 0.75 times the most strict threshold defined for either the presence or timeliness tests (discussed below). If 75% of the time-indexed curves are missing according to this strict threshold, the system generates a single alert for the entire wellbore, and suppresses individual curve alerts. This avoids creating hundreds of individual alerts if the entire data stream has stopped.

Figure 18:
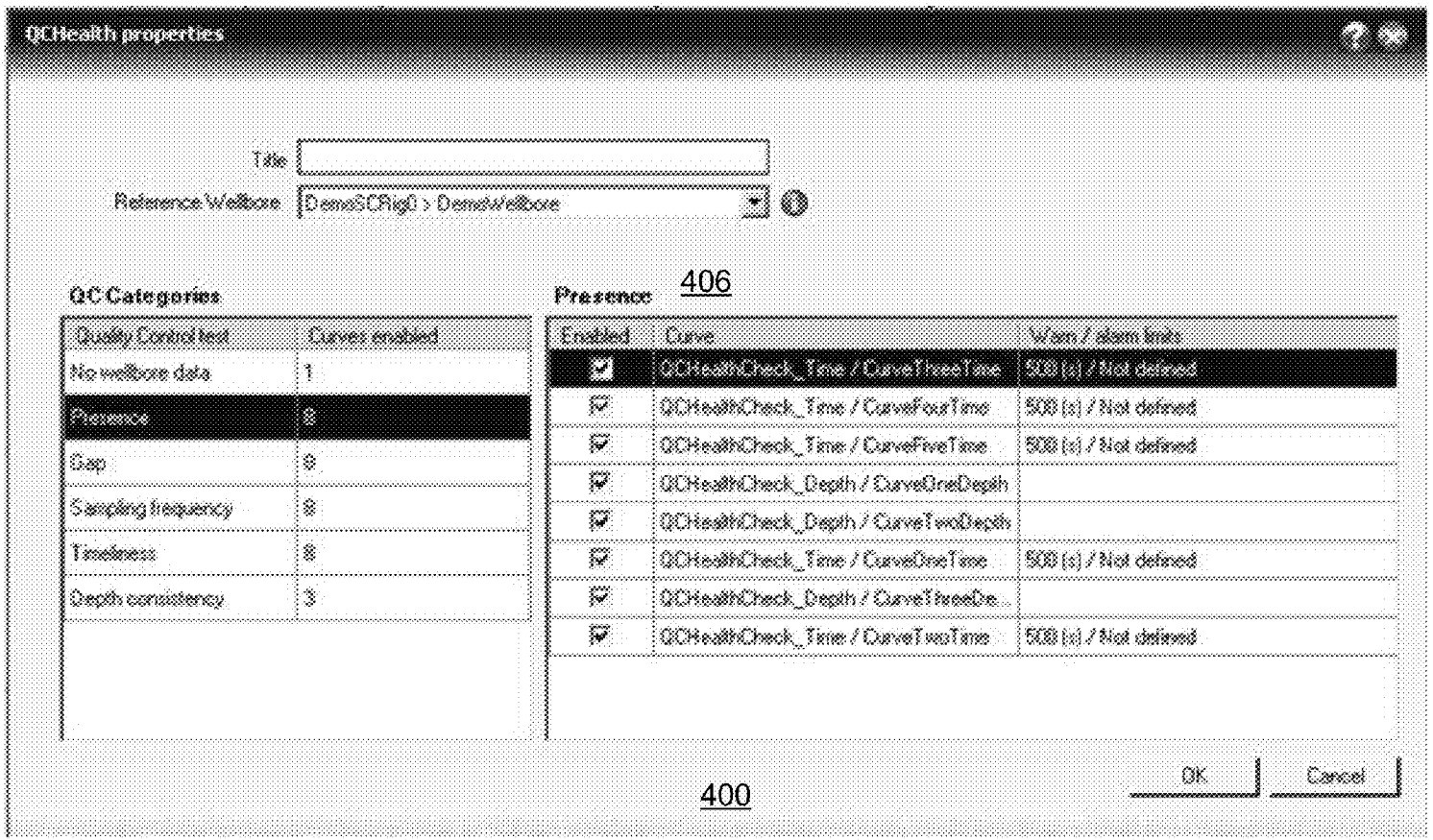
FIG. 18 shows an example of a Data Quality properties window with "Presence" test option.

The "Presence" test 406, as seen in FIG. 18, determines if a defined curve or data stream is present, and an alert is generated if the curve is not present. Detection methods include a simple check for the presence of the curve or data stream in the system server, and for time-indexed curves or data, a check that data has been received within a specified amount of time (e.g., N seconds or minutes).

Figure 19:
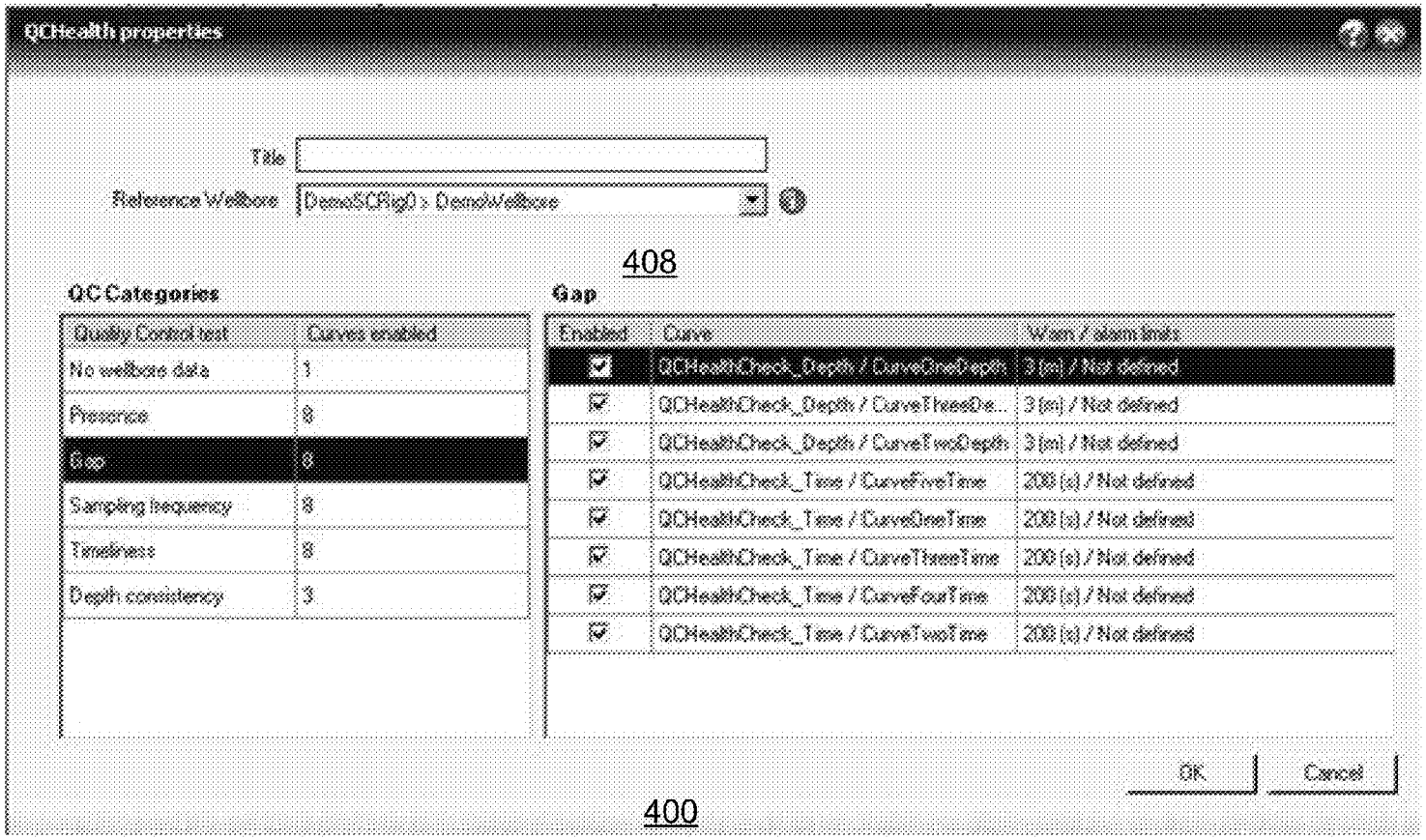
FIG. 19 shows an example of a Data Quality properties window with "Gap" test option.

The "Gap" test 408, as seen in FIG. 19, checks the time and/or distance between two consecutive data points in the data buffer, and generates an alert if the time and/or distance between two consecutive data points exceed a defined threshold. In the example shown, these warning thresholds have been set at 3 meters for a depth curve, and 200 seconds for a time curve.

Figure 20:
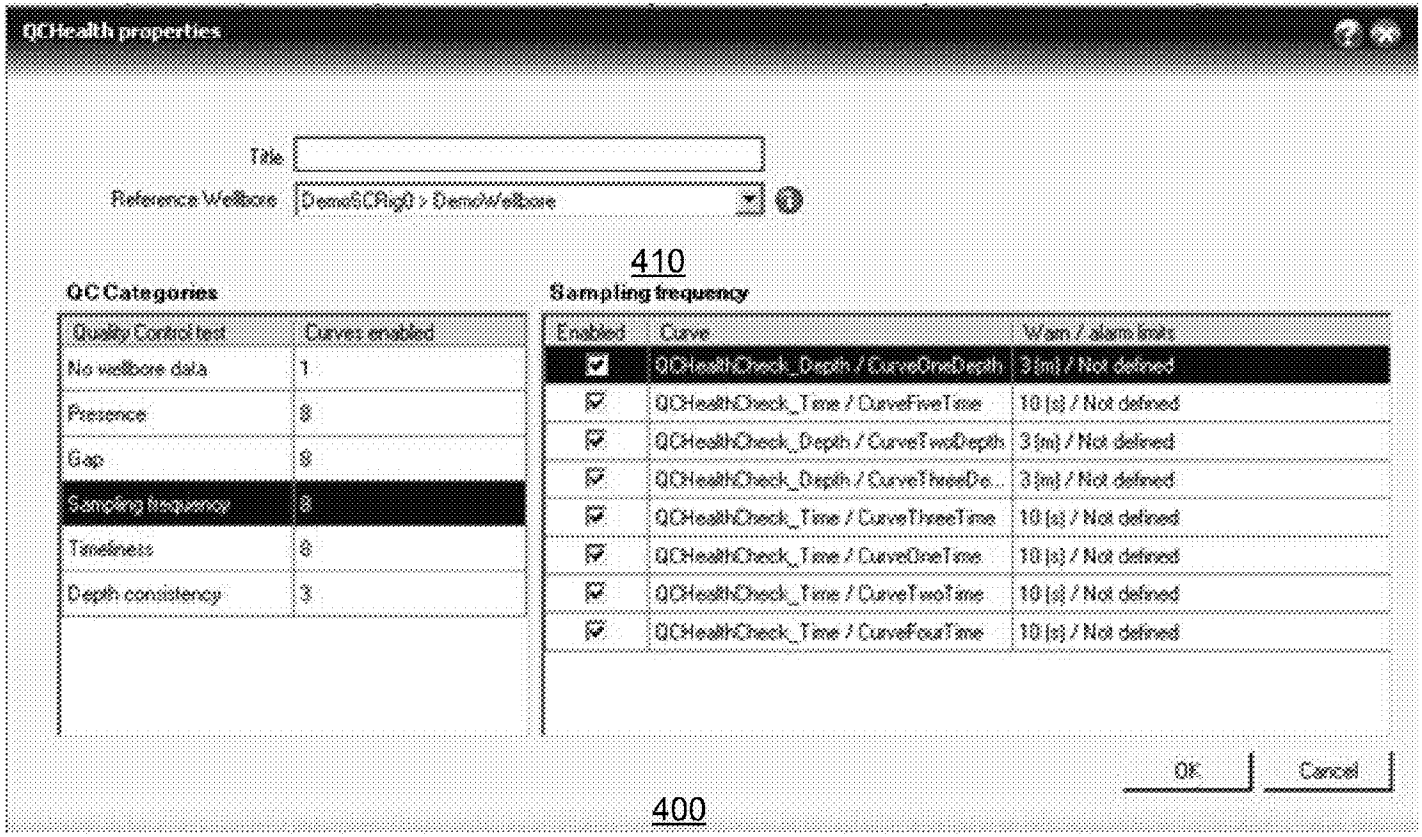
FIG. 20 shows an example of a Data Quality properties window with "Sampling Frequency" test option.

The "Sampling Frequency" test 410, as seen in FIG. 20, similarly checks the time and/or distance between two consecutive data points in the data buffer, and generates an alert if the time and/or distance between two consecutive data points exceed a defined threshold. In the example shown, these warning thresholds have been set at 3 meters for a depth curve, and 10 seconds for a time curve.

Figure 21:
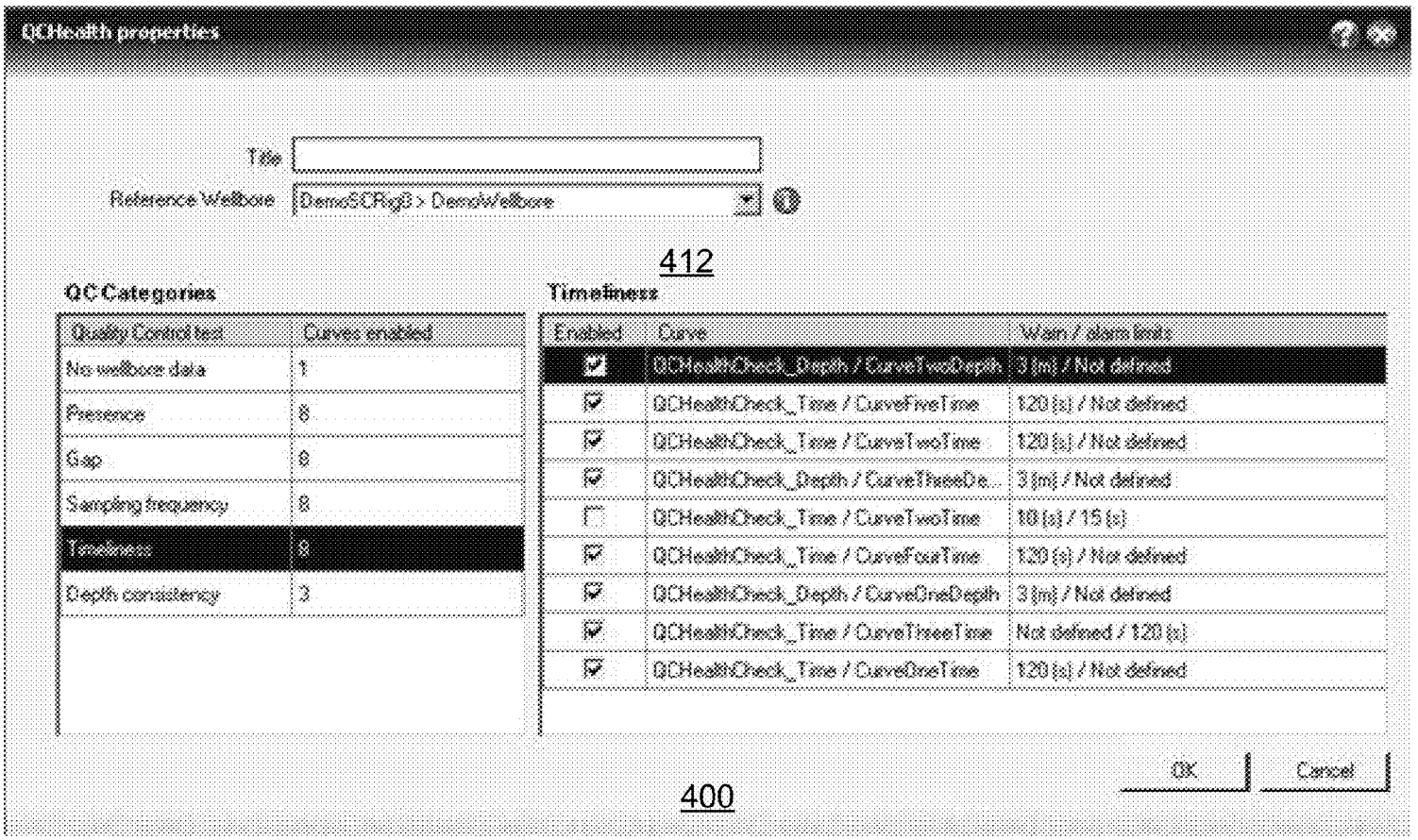
FIG. 21 shows an example of a Data Quality properties window with "Timeliness" test option.

The "Timeliness" test 412, as seen in FIG. 21, checks if the time since the system last received a data point exceeds a defined threshold. This test is independent of the rig clock, since the test is based on when the data point was last received in the server. For depth indexed curves, the system identifies if the curve lags behind the hole-depth by more than the length of the bottom-hole assembly plus the sampling interval.

Figure 22:
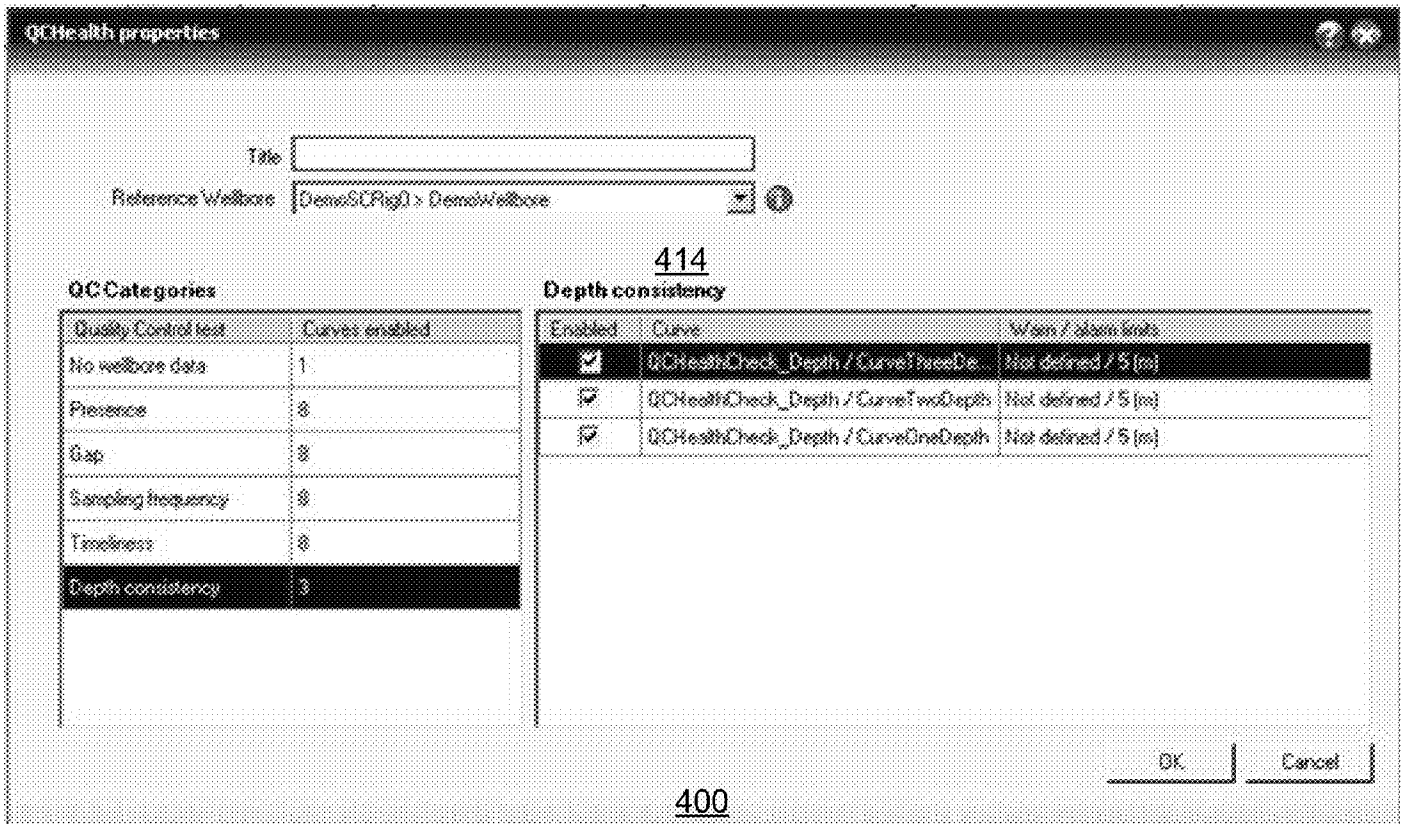
FIG. 22 shows an example of a Data Quality properties window with "Depth Consistency" test option.

The "Depth Consistency" test 414, as seen in FIG. 22, checks if the reported sensor index is beyond the hole-depth as reported from the hole-depth curve or data stream.

Additional tests include, but are not limited to, the following:

Value Range test (tests whether values are within an appropriate range)

Rogue Value test (tests whether a spike or outlier data point or points exist)

Jump In Index Value test (tests whether there is a jump in the index value, e.g., jumps in depth)

Sensor Comparison test (tests whether two similar sensors give approximately the same result)

Adaptive Detection of Tool Offset test (tests how far behind the gamma sensor is on a current run)

Trajectory Continuity test (tests whether the trajectory is continuous)

WITSML Object Metadata Presence test (tests for presence of metadata in the specific object)

Curve Expectation test (tests rig state/activity code/macrostate to determine if a curve is expected).

In one embodiment, there is a set of dependencies between multiple tests. A test will not raise an alert if any of the tests on which it depends is in an alarm state, thus eliminating a potential overflow of possibly redundant alerts. In one exemplary embodiment, the dependency order is: presence; timeliness; depth consistency; gap; and sampling frequency. Thus, for example, if a curve is missing (i.e., the presence test is failed), the alarm for the presence test should trigger for that curve, and the gap and sampling frequency tests, which would, per force, fail as well, will not trigger their own alerts for the curve. If the presence test is met, but the gap alarm is triggered, then the sampling frequency test will not trigger an alert.

Accordingly, the system has dynamic evaluation of which data quality checks to run at any given time based on test dependencies, or range type and current state. In one embodiment, the system uses hole section or depth range to group data quality requirements appropriately, and determine if a curve or data stream is expected. In one particular embodiment, there are three range types: from start of curve range, depth range, and run number range.

In an exemplary embodiment, the system compensates for clock drift. The system uses timestamps to function even if the system clock at the rig or platform is wrong or in a different time zone. In one embodiment, the system creates an "AlarmRangeTime" entity which determines the duration between an alarm becoming active and it becoming inactive. This information is stored, and tagged with the responsible role/actor, responsible subsystem, and ticket reference to store each occurrence of an alarm. This tags the alarm for later reporting, and allows the system to create aggregated reports showing the percent of downtime for the various data vendors or responsible roles. This information can then be used to monitor contract compliance. Similarly, the system can provide KPI (Key Performance Indicator) calculations for service providers based on aggregated event durations.

Figure 23:
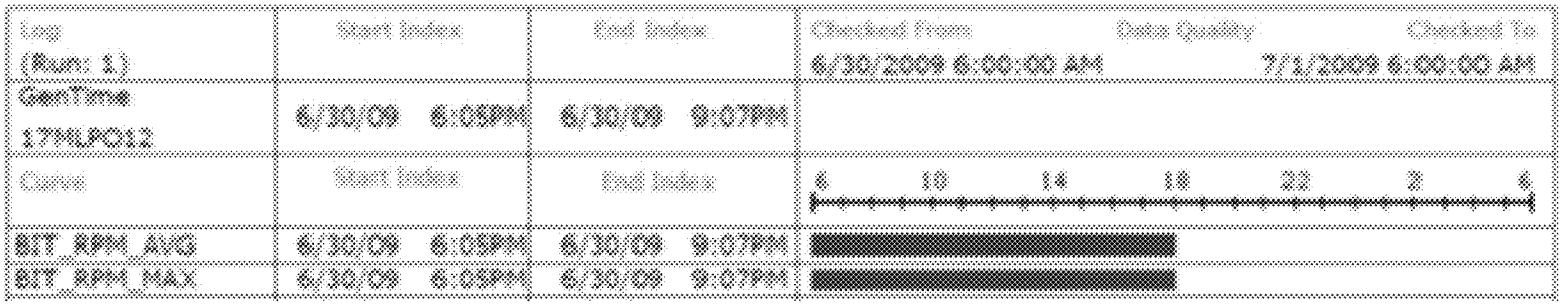
FIG. 23 shows an example of a data gap report.

The system also can prepare and provide a number of reports that present the data quality information history for a desired period of time. In one embodiment, for example, the system and render data gaps as a bar diagram, as shown in FIG. 23. In one embodiment, the system provides gap filling, if desired. The system synchronizes the real time data quality check with a synchronizer module. The synchronizer module asks the data quality system every ten minutes (or other time period, as desired) if there were any gaps in the data in the preceding ten minutes (or the duration of the time period), and if so, the module will backfill the data. When completed, a handshake operation takes place and the backfill attempt is stored in the central quality control database, and can be subsequently contained in a report.

The system also may replicate alarms from a distributed system to a centralized location using the Internet or xml. Audible signals may be used in conjunction with the severity alert icons to draw the attention of the user.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A system for monitoring data stream quality at a well-site, comprising:

a plurality of sensors to sample or detect parameters related to drilling or production operations in a well, wherein said one or more of said parameters may be time-indexed, said plurality of sensors comprising surface sensors or downhole sensors or a combination thereof;

one or more computing devices adapted to receive parameter information in real time from said plurality of sensors, said one or more computing devices each further comprising a processor or microprocessor, said processor or microprocessor adapted to process the received parameter information to calculate derived parameters, and to perform one or more data quality checks on the received parameter information or the derived parameters; and a visual display, coupled to said one or more computing devices, for displaying some or all of the received parameter information and said derived parameters, and for displaying one or more indicators of data quality states based on the one or more data quality checks;

wherein the data quality checks comprise the following:

a data flow presence test to indicate whether data for a particular parameter has been received, and for time-indexed parameters, whether data for a particular time-indexed parameter has been received within a specified amount of time;

a data flow gap test to indicate whether a gap between two consecutive data points for a particular parameter exceed a defined gap threshold value, where the gap threshold value is a distance for a distance-based parameter and a time period for a time-based parameter;

a data flow sampling frequency test to indicate whether a sampling frequency for a particular parameter exceeds a defined sampling frequency threshold value, where the sampling frequency threshold value is a distance for a distance-based parameter and a time period for a time-based parameter;

a data flow timeliness test to indicate whether a time the one or more computing devices last received a data point for a particular parameter exceeds a defined timeliness threshold value, where the timeliness threshold value is a distance determined by the length of a bottom-hole assembly and the sampling interval for a distance-based parameter and a time period for a time-based parameter; and a data flow depth consistency test to indicate whether a sensor depth index for a particular parameter exceeds the reported hole depth.

2. The system of claim 1, wherein the visual display of some or all of the received parameter information and said derived parameters, and said data quality indicators, is in real time.

3. The system of claim 1, said one or more computing devices further comprising at least one software smart agent having one or more formulations applicable to drilling or production operations in a well.

4. The system of claim 1, wherein said one or more indicators of data quality are displayed together on the visual display.

5. The system of claim 1, wherein the different indicators of data quality are used to indicate different data quality states.

6. The system of claim 1, wherein the processor or microprocessor is further adapted to determine a single aggregate data quality indicator to represent a plurality of individual data quality indicators.

7. The system of claim 6, wherein the single aggregate data quality indicator is determined based upon a set of rules.

8. The system of claim 6, wherein the single aggregate data quality indicates an alert state no less than the highest alert state in the plurality of individual data quality indicators.

9. The system of claim 1, wherein the data quality checks are arranged in a set of hierarchical dependencies, and a data quality check will not raise an alert if any of the data quality checks on which it depends are in an alarm state.

10. The system of claim 9, wherein the hierarchical dependency comprises the following, from independent to most dependent: presence test, timeliness test, depth consistency check, gap test, and sampling frequency test.

11. The system of claim 1, wherein the system dynamically determines which data quality checks to run at a particular time based on well section or depth range.

12. The system of claim 1, wherein the system dynamically evaluates which data quality checks to run at a particular time based on hierarchical dependencies.

13. The system of claim 1, further comprising one or more audible signals used as indicators of certain data quality states.

14. The system of claim 1, wherein the data quality checks further comprise one or more of the following:

a data flow value range test to indicate whether data values for a particular parameter are within a predetermined range;

a data flow rogue value test to indicate whether one or more spike or outlier data values for a particular parameter are present;

a data flow jump-in-index-value test to determine whether there is a jump in the index depth value for a particular parameter; and a data flow sensor comparison test to determine if data values from two or more sensors are approximately the same.

* * * * *